US011596244B1

(12) United States Patent
Fedorko

(10) Patent No.: US 11,596,244 B1
(45) **Date of Patent: *Mar. 7, 2023**

(54) MODULAR DISPLAY CASE

(71) Applicant: Donald J. Fedorko, Des Peres, MO (US)

(72) Inventor: Donald J. Fedorko, Des Peres, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/372,884

(22) Filed: Jul. 12, 2021

Related U.S. Application Data

(63) Continuation-in-part of application No. 16/566,935, filed on Sep. 11, 2019, now Pat. No. 11,058,233.

(60) Provisional application No. 62/729,734, filed on Sep. 11, 2018.

(51) Int. Cl.

| | |
|---|---|
| ***A47F 3/00*** | (2006.01) |
| ***A47F 11/10*** | (2006.01) |
| ***A47F 3/12*** | (2006.01) |
| ***A47G 1/12*** | (2006.01) |
| *G09F 13/18* | (2006.01) |

(52) U.S. Cl.
CPC ..... *A47F 3/004* (2013.01); *A47F 3/001* (2013.01); *A47F 3/005* (2013.01); *A47F 3/12* (2013.01); *A47F 11/10* (2013.01); *A47G 1/12* (2013.01); *A47G 2200/08* (2013.01); *G09F 2013/1872* (2013.01)

(58) Field of Classification Search
CPC ..... A47F 3/001; A47F 3/004; A47F 3/005; A47F 3/12; A47F 11/10; A47G 1/12; G09F 2013/1872
USPC ..... 40/714
See application file for complete search history.

(56) References Cited

U.S. PATENT DOCUMENTS

| | | | | |
|---|---|---|---|---|
| 2,535,149 | A | 12/1950 | McBride | |
| 2,634,530 | A * | 4/1953 | Gates, Jr. ..... | G02B 6/0091 40/764 |
| 2,841,272 | A | 7/1958 | Dreier | |
| 3,318,032 | A | 5/1967 | Robison | |
| 4,271,619 | A | 6/1981 | Schmidt | |
| D297,896 | S | 10/1988 | Welborn | |
| 4,879,145 | A | 11/1989 | McLellan | |
| D310,454 | S | 9/1990 | Beasley | |
| 5,277,949 | A | 1/1994 | Green | |
| 5,303,489 | A | 4/1994 | Blegen | |

(Continued)

OTHER PUBLICATIONS

Living Patriot, LLC, shop [online], Apr. 16, 2011. <http:/web.archive.org/web20110416010514/http:/www.livingpatriot.com/prism-phots/> (Year: 2011).*

(Continued)

*Primary Examiner* — James O Hansen
(74) *Attorney, Agent, or Firm* — Creativenture Law, LLC; Dennis J M Donahue, III; Kevin Staed

(57) ABSTRACT

A modular display case having a series of adjacent panels an upper portion of two panels supporting an item for display and base portion for support. The base portion may also include a chamber for housing an illuminating LED strip within the base of the case. The case is made from multiple layers of material the front panel and back panel which are connected with fasteners to allow the display to be taken apart to situated the item therein. The item held in the display is visible through the clear panel material which provides viewing windows on the front and rear of the case.

20 Claims, 17 Drawing Sheets

(56) References Cited

U.S. PATENT DOCUMENTS

| | | | | |
|---|---|---|---|---|
| 5,383,293 | A * | 1/1995 | Royal | A47G 1/0616 40/768 |
| 6,073,374 | A * | 6/2000 | Tingmo | G02B 6/0043 40/714 |
| 7,007,417 | B2 * | 3/2006 | Segan | G09F 27/00 40/716 |
| 7,028,425 | B2 | 4/2006 | Lasher | |
| 7,080,918 | B2 | 7/2006 | Rowland | |
| 7,219,460 | B1 | 5/2007 | Grayson | |
| 7,591,097 | B2 | 9/2009 | Alman | |
| 8,038,309 | B2 * | 10/2011 | Yang | A47G 1/0622 362/604 |
| 9,284,745 | B2 | 3/2016 | Marco | |
| D806,449 | S | 1/2018 | Pennington | |
| 2007/0273253 | A1 | 11/2007 | Fair | |

OTHER PUBLICATIONS

Living Patriot, LLC, shop [online], "Banner Display", Apr. 6, 2017. <www.livingpatriot.com/store/> (Year: 2017).*

Living Patriot, LLC, Shop [online], Apr. 16, 2011. Retrieved from the Internet: <http://web.archive.org/web/20110416010514/http://www.livingpatriot.com/prism-photos/>.

Living Patriot, LLC, Shop [online], Apr. 6, 2017. Retrieved from the Internet: <www.livingpatriot.com/store/>.

* cited by examiner 10
12
14
16
18
18
42
28
50
48

20
12
14
72
$s_t$
70
16
22
20
22
34
$d_w$ 46
44
48
40

66
68
$s_w$
54
24
32

MODULAR DISPLAY CASE

CROSS-REFERENCE TO RELATED APPLICATIONS

This application is a continuation-in-part of U.S. patent application Ser. No. 16/566,935 filed on Sep. 11, 2019 which claims priority from U.S. Provisional Patent Application No. 62/729,734 filed on Sep. 11, 2018.

STATEMENT REGARDING FEDERALLY SPONSORED RESEARCH

Not Applicable.

APPENDIX

Not Applicable.

BACKGROUND OF THE INVENTION

Field of the Invention

The present invention relates to display cases, and more particularly to modular illuminated display cases for memorabilia.

Related Art

Display cases have long been used for displaying memorabilia and similar items in homes, offices, and in public spaces. Most display cases include a single chamber that houses the item and a glass or otherwise transparent viewing window through which the item can be viewed while also being somewhat protected. Cases have also been particularly sized and shaped to accommodate specific items, for example a folded flag.

Displays may also be illuminated in many different fashions but are often times illuminated by room light or external attached light fixtures. However, this practice results in undesirable lighting within the frame. Prior attempts to improve frame lighting have moved the light sources within the display. Interior display lighting presents difficulties in hiding the light source, distributing the light evenly, and connecting a power supply to the light source. As one solution, the display in U.S. Pat. No. 7,080,918 by Grant describes an integrated LED light source in a compartment below the display compartment that is hidden by a divider that is light impermeable and has an aperture to let some light into the display compartment. The Grant '918 Patent is similar to many other display cases in which a front face is mechanically attached to one of the sides of the display case through a hinge so that the front can open to place items into the display chamber, but the front cannot be entirely removed from the sides of the display case without disassembling the hinges that hold the front to the display case. Additionally, the Grant '918 Patent uses a standard form to produce the display case with solid sides in which the width of the sides define the depth of the display case.

The original Living Patriot® display case had created a new type of modular prismatic display case in which multiple frames, as generally shown in FIG. 1, were fastened together to form a display chamber. The prismatic display case had been formed separate from a base on which the prismatic display case could be seated. The base housed a light beneath a diffuser panel, and when the prismatic display case was seated on the base, the light would illuminate the display chamber. The front panel of the prismatic display case had been connected to the inner panels with the same screw fasteners that connected the inner panels with the back panel and hold the prismatic display case together. The screws that extend through the front panel would have to be removed from the screw post in order to remove the front panel and get access the display compartment for placing or removing an item therein. Accordingly, even with the known prismatic display case in which the display chamber is formed by the frame panel sections, there had remained a desire for improving the display case to improve the manufacturability of the display case and to simplify the access to the display chamber while avoiding hinges or other mounts between the front panel and sides.

SUMMARY OF THE INVENTION

The present invention is a modular display case having a chamber for holding an item to be displayed, such as a folded flag, as well as a chamber for housing an illuminating strip within the base of the modular case. The case preferably has a prismatic shape made from multiple A-shaped acrylic inner frame panels separated by spacers and connected together with a rear panel by sets of fasteners, and a front panel can be placed over and removably connected to the front most inner frame panel. The preferred fastener is a post and screw that extends from its permanent connection on the rear panel of the case through holes within each layer of the case. Additionally the head of the fastener opposite from the rear panel removably engages a magnet connected to the removable front panel. Accordingly, the magnets engage the ferrous head of the post and hold the front face onto the display.

The item held in the display chamber is visible through slats between the inner frame panels as well as through the viewing windows on the front and rear panels of the case. The rear panel of the case is generally attached to the interior layers of the case by the fasteners whereas the front panel is removably attached to the rest of the body and thereby permits quick and easy access to the display chamber. Additionally, the preferred embodiment has a top section that is made from a clear acrylic or otherwise transparent material allowing each portion of the item within the display chamber to be visible.

Another aspect of the invention is an integrated base portion comprised of the bottom side of the inner panels and another set of spacers below the upper portion of the A-shaped case. The front panel also has a separate base portion detached from the triangular upper section where the bottom edge of the lid portion of the panel is seated against the top edge of the base portion. Additionally, a front cover connects to the base and they collectively provide a lip and tray to further support the front lid panel.

In another aspect of the case, a chamber for housing an LED light strip to illuminate the display chamber is positioned within a cutout in the bottom side of the inner panels. To allow light to pass into the display chamber, a top light diffuser plate forms the top of the chamber and another light diffuser forms the bottom of the chamber. Accordingly, the LED strip illuminates the item within the display chamber above through the top diffuser as well as provides an under-glow beneath the entire unit through the bottom diffuser. Further, the slats between the inner panels allow light to escape and better illuminate the item held within the display chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings as summarized below.

DETAILED DESCRIPTION OF THE PREFERRED EMBODIMENTS

Figure 1:
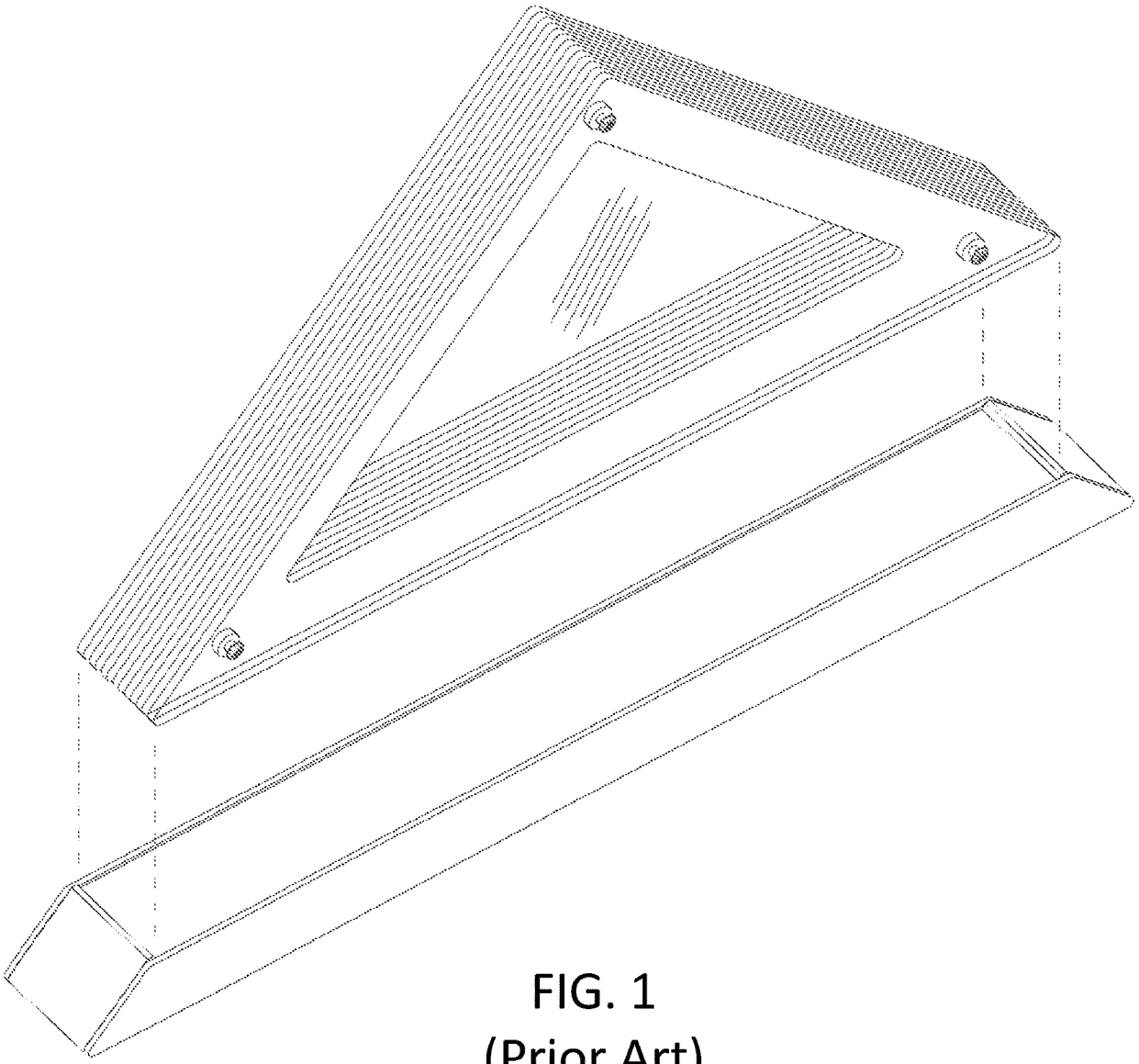
FIG. 1 (Prior Art)
FIG. 1 is an isometric view of a prior art display case.

The following description of the preferred embodiment(s) is merely exemplary in nature and is in no way intended to limit the invention, its application, or uses.

As generally shown in the accompanying drawings for the various embodiments of the present invention, a modular display case 10 is formed from multiple flat panels 12, 14, 16 that are fastened together. A front panel 16 is secured to a front most inner panel 14 through a set of releasable fasteners 18, and the inner panels are connected to each other and to the rear panel 12 through a set of mechanical fasteners 20. Preferably, the mechanical fasteners also connect spacers 22 between the inner panels. The inner panels 14 have an upper portion 38 and a base portion 40, and the panels in the base portion are fastened together with a front base panel 28 and a rear base panel 30 connected to a rearmost inner panel 14' opposite from the front most inner panel 14" to form the base support 42 of the display case.

As described below with reference to FIGS. 2-5, the upper portion of the inner panels can be formed with side sections 44 that together with the base portion form a frame 46 that encloses an interior space 48 and which together form a display chamber 50. Alternatively, as described below with reference to FIG. 6, the upper portion can be formed by different interior shapes or designs 52*a*', 52*a*", 52*b*, 52*c* that extend from the base portion of the inner panels and can be enclosed by a frame 46 but are not necessarily enclosed. Preferably, in each version of the display case 10, the base portion of the inner panels has a cutout section 54 and together they form a base chamber 56 that and holds a light 24 and a diffuser panel 32 above a bottom edge 98 of each inner panel. The diffuser panel is preferably translucent and is positioned between the light and the upper side 100 of the cutout section. Sections of the bottom edge can be raised to provide a space underneath the display case where the light shines out onto the surface on which the display case is seated.

The light is preferably a light panel assembly that has one or more strips of LEDs 24*a* mounted to a flat board 24*b* and is seated on the lower side 102 inner panels' cutout section, i.e., the bottom of the base chamber. The flat board preferably matches the shape of the base chamber, and the LEDs are spaced out along the length and width of the board to help evenly distribute the light to the display chamber. As particularly shown in FIG. 2J, a single strip of LEDs has a pair of long LED sections connected by a short LED section. In the preferred embodiments, the panels are transparent and have a prismatic shape so when the light enters the bottom of the panels, it is refracted and directed to the upper portions where it impinges on the edges of the panels and illuminates the item within the interior of the display chamber while also providing an edge lighting glow effect around the exterior side of the panels. The spacers between the inner panels create open slats or spaces through which ambient air can circulate and dissipate the heat generated by the light. Additionally, the raised floor below the base chamber between the rear and front panels provides a bottom space underneath the light panel for the ambient air to flow and provide a natural convection for additional heat dissipation from the light panel.

Figures 2A, 2B, 2C, 2D:
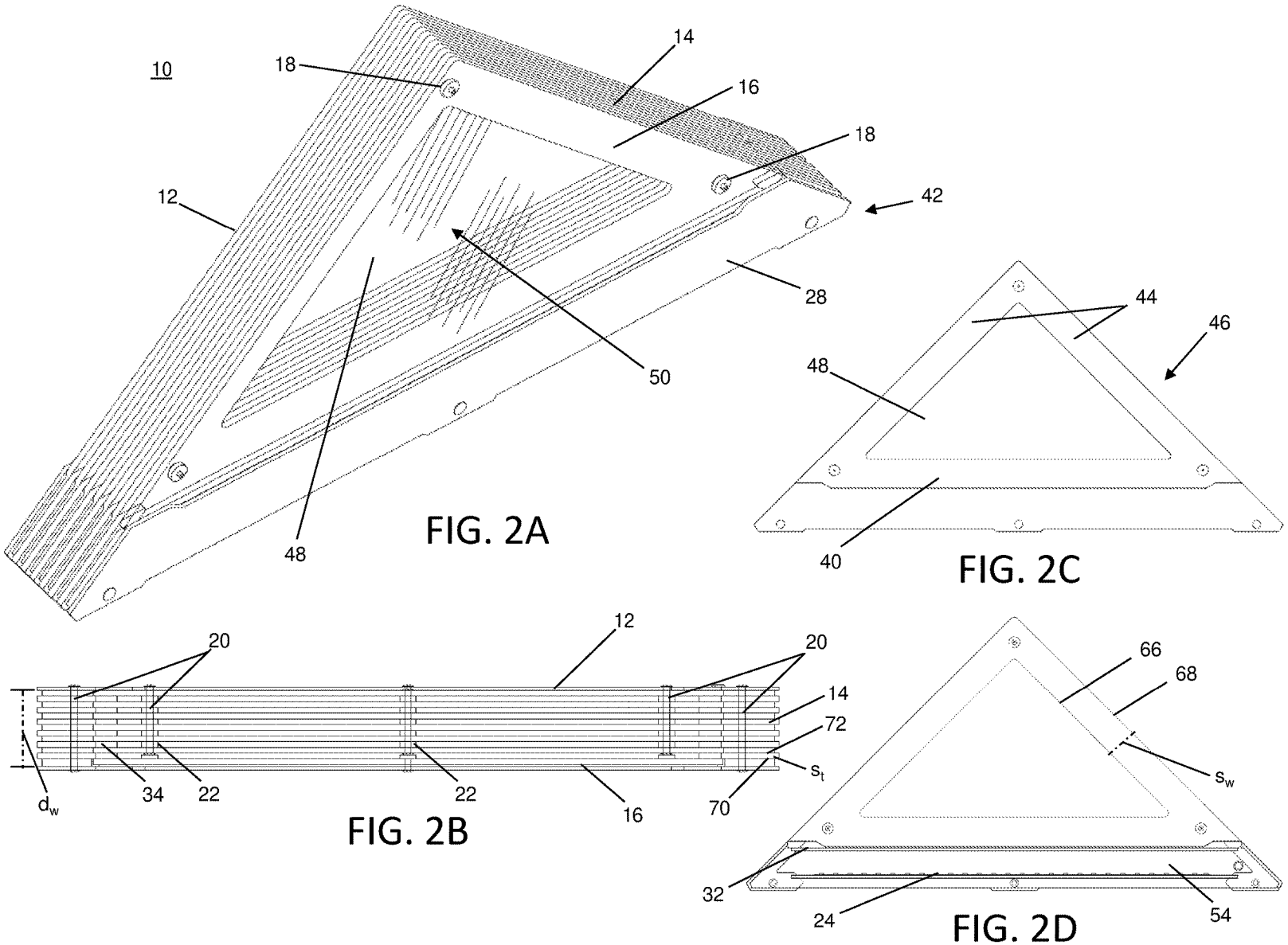
FIG. 2A shows a perspective view of a first embodiment of the modular display case according to the present invention.
FIG. 2B shows a top view of the first embodiment.
FIGS. 2C and 2D show a front view and front cross sectional view, respectively, of the first embodiment.
Figure 2F:
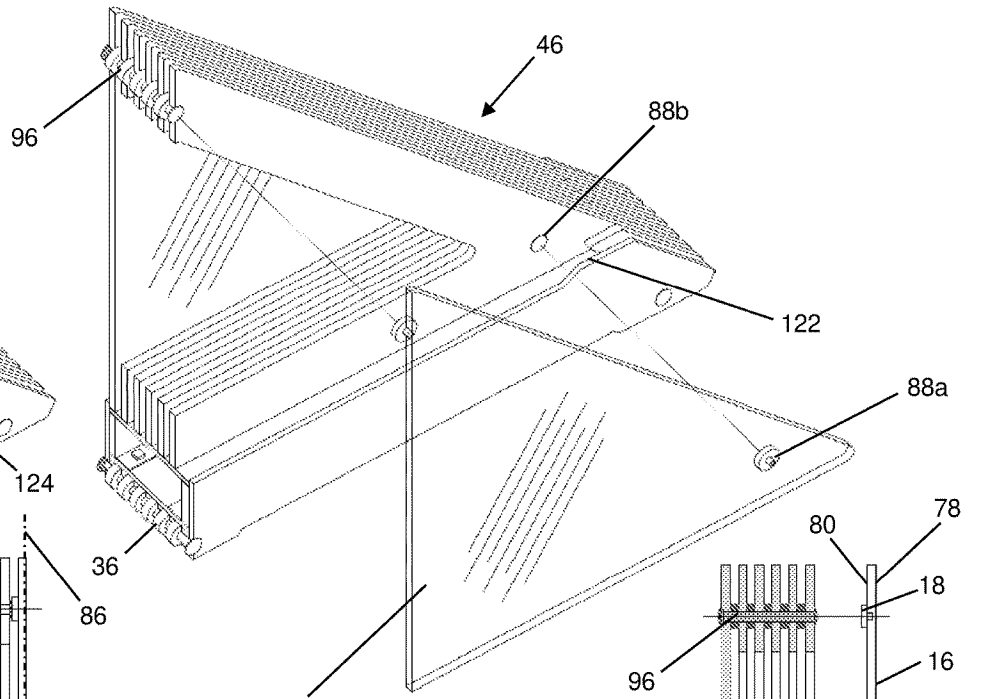
FIGS. 2E and 2F show a cross sectional perspective view of the first embodiment with a front panel connected to the display case and the front panel removed from the display case, respectively.
Figure 2H:
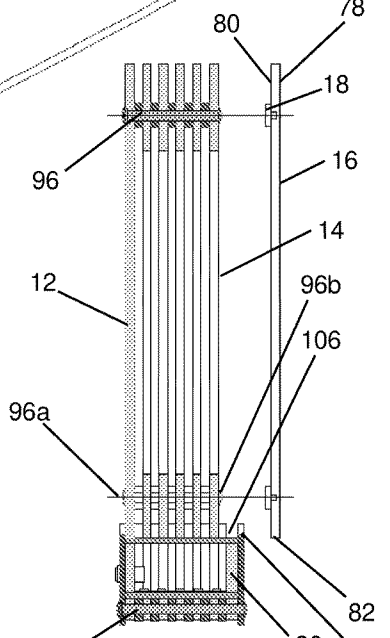
FIGS. 2G and 2H respectively show the first embodiment in a side view with the front panel connected to the display case and a cross sectional side view with the front panel removed from the display case.
Figure 2E:
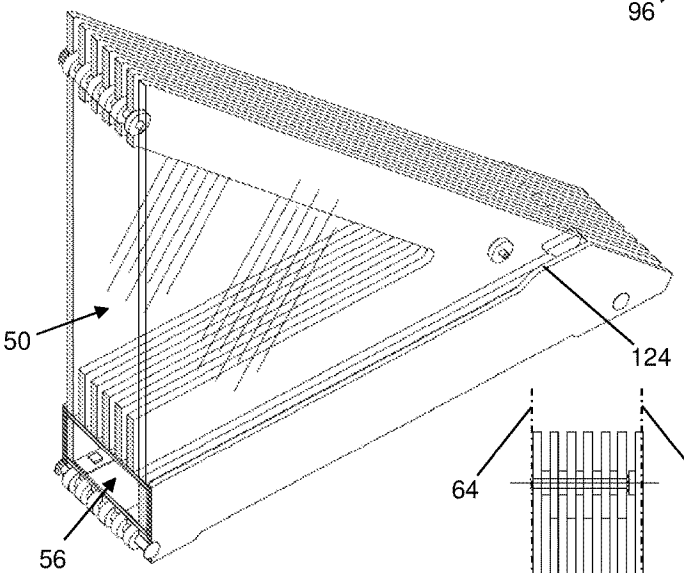
Figure 2G:
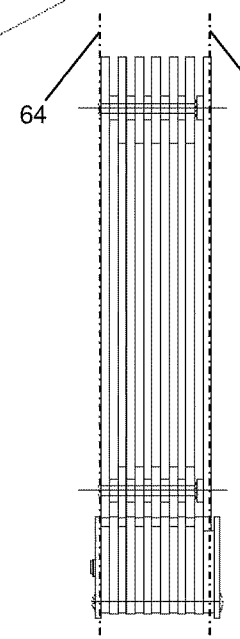

Preferably, the releasable fasteners are magnetic fasteners 88 that are attached to corresponding corners of the front panel and the front most inner panel. It will be appreciated that any type of releasable fastener can be used to releasably connect the front panel to the display case. For example, in place of magnetic fasteners, hook and loop fasteners, clasp fasteners, or snap fasteners could be used. Accordingly, the front panel has an engaged position as shown in FIGS. 2E and 2G in which it is connected to the display case through the engagement of the releasable fasteners and a disengaged position as shown in FIGS. 2F and 2H in which it is spaced free from the display case when the releasable fasteners are disengaged from each other. When the front panel is in the engaged position, it is situated in a plane 86 parallel to the longitudinal plane 64 of the rear panel. When the front panel is off of the display case, the display chamber is open to receive the item that is to be held within the display chamber.

The display cases 10 shown in FIGS. 2-5 include the rear panel 12 and the front panel 16 and also preferably include a base chamber cover 26 that is situated between the front base panel 28 and the front most inner panel 14. The rear panel and the front panel respectively enclose the back and front of the corresponding display chambers that are formed by the frame 46 of the inner panels 14. In these embodiments, the base portion 40 extends between the side sections 44, and the frame section preferably has an identical shape 46*a* for each one of the inner panels 14*a*. In comparison, for the display case 10 shown in FIG. 6, the inner panels 14*b* can have different shapes. In each one of the embodiments, the width ($s_w$) of the side sections between the interior edge 66 and the exterior edge 68 is greater than a thickness ($s_t$) of the side sections between the forward face 70 and the rearward face 72 ($s_w > s_t$). For the display cases in which the inner panels 14 have a frame section, each inner panel has a periphery shape 74 that substantially matches and is aligned with the outer periphery 62 of the rear panel, and the forward face and the rearward face are each situated in a plane 86 parallel to the longitudinal plane 64 of the rear panel. By adding more inner panels and more spacers 22, the width ($d_w$) of the display chamber between the rear panel and the front panel can be greater than the width of the inner panel's side sections ($d_w > s_w$).

The rear panel 12 has a rear face 58 and a forward facing inner surface 60. The rear panel and each one of the inner panels have a plurality of apertures 90. The apertures in the rear panel are located proximate to the rear panel's outer periphery 62, preferably in the corner regions of the panels, and the apertures in the inner panels are respectively aligned with the apertures in the rear panel along a set of lateral axes 92 that are substantially perpendicular to the longitudinal plane of the rear panel. The spacers 22 each have an aperture 94 and are positioned between adjacent pair of inner panels, and the spacers between the upper portions of the inner panel are preferably transparent and circular. The axes extend through the apertures of the respective spacers, and the mechanical fasteners extend along the axes through the apertures of the inner panels and the spacers.

The rear panel preferably includes an upper slit 116 and a lower slit 118 that are respectively aligned with the upper side 100 and the lower side 102 of the inner panel's cutout section which are substantially aligned with the bottom edge. The base chamber cover 26 also preferably includes a slit 120 that is aligned with the lower side of the cutout section. Opposite longitudinal sides 24*c* of the light panel's support board 24*b* extend into the lower slit in the rear panel and the slit in the base chamber cover, and a longitudinal side 32*a* of the diffuser panel extends into the upper slit in the rear panel. The base portion in each one of the inner panels has a pair of recesses 114 on opposite sides of the cutout section proximate to the upper side, and opposite lateral ends of the diffuser panel respectively extend into the pair of recesses.

As indicated above, the front panel 16 is spaced from the rear panel 12 by one or more inner panels 14 and preferably also spacers 22. The front panel has a front face 78 that is the outer front surface of the display case and a rearward facing inner surface 80 that faces toward the display chamber. The front panel's bottom side 82 is seated on a top edge 106 of the base chamber cover 26. The front panel's upper periphery 84 substantially matches and is aligned with the periphery shape 74 of the inner panel side sections 44. At least a portion of the upper edge 122 of the front base panel 28 extends beyond the top edge of the base chamber cover and forms a lip 124 or wall adjacent to the bottom side of the front panel. Together with the upper edge of the front base panel and the base portion of the front most inner panel, the lip forms a channel that holds the front panel's bottom side. The lip does not need to extend along the entire front panel; as particularly shown in FIGS. 2A and 2E-2H, a pair of lip segments are located on opposite ends of the front base panel.

Figure 2I:
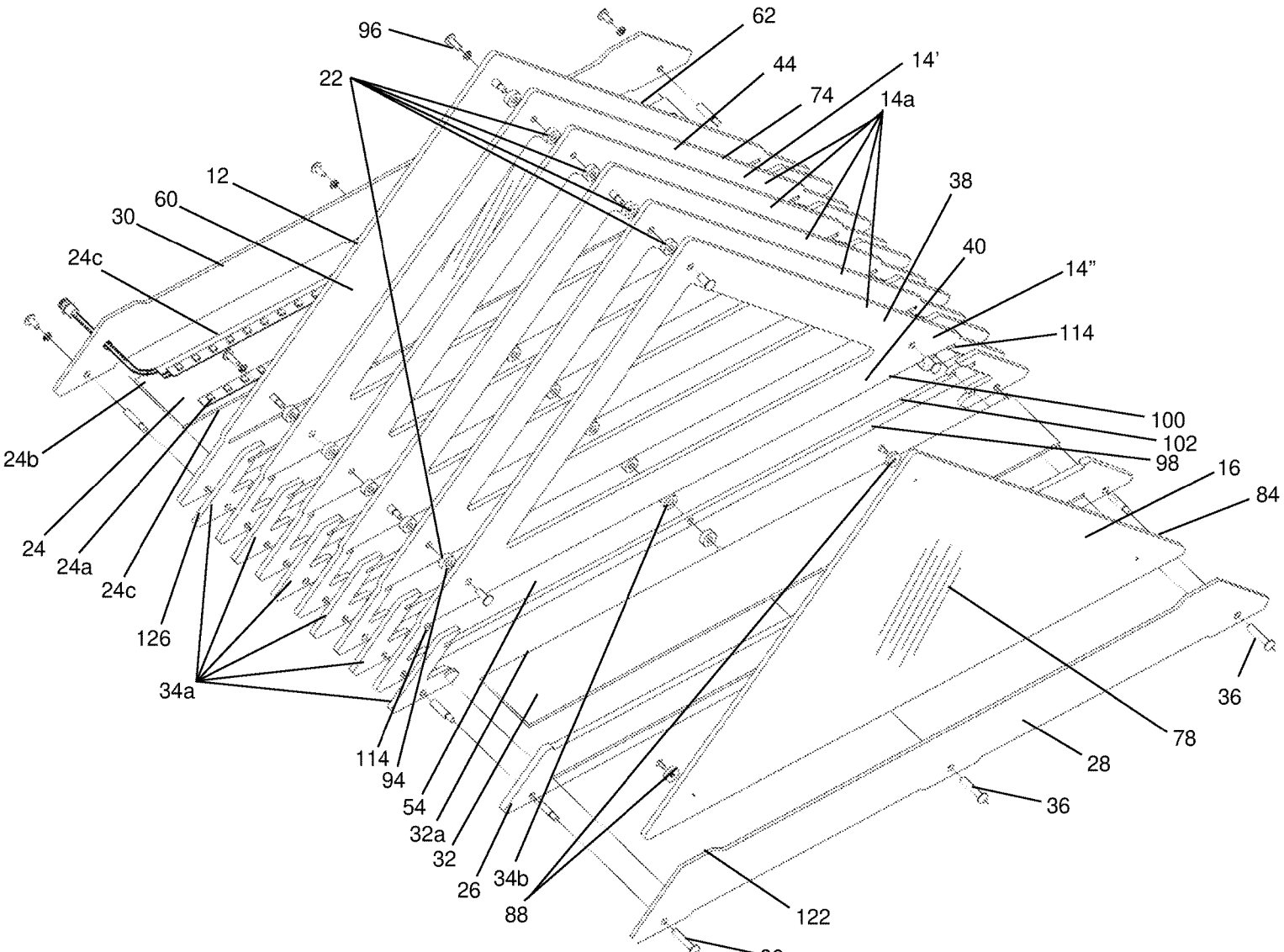
FIGS. 2I and 2J respectively show front and back exploded isometric views of the first embodiment.
Figure 2J:
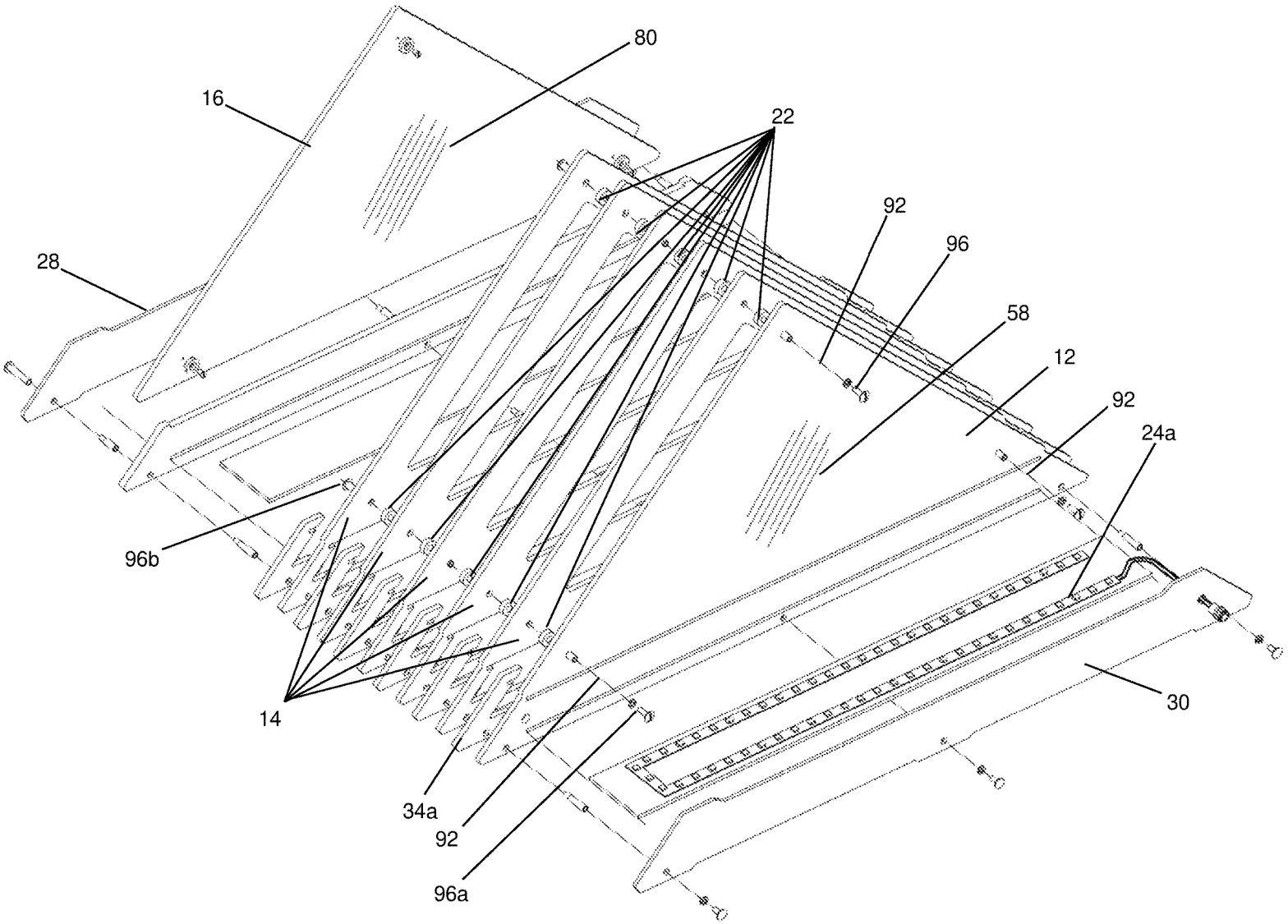
Figure 3A:
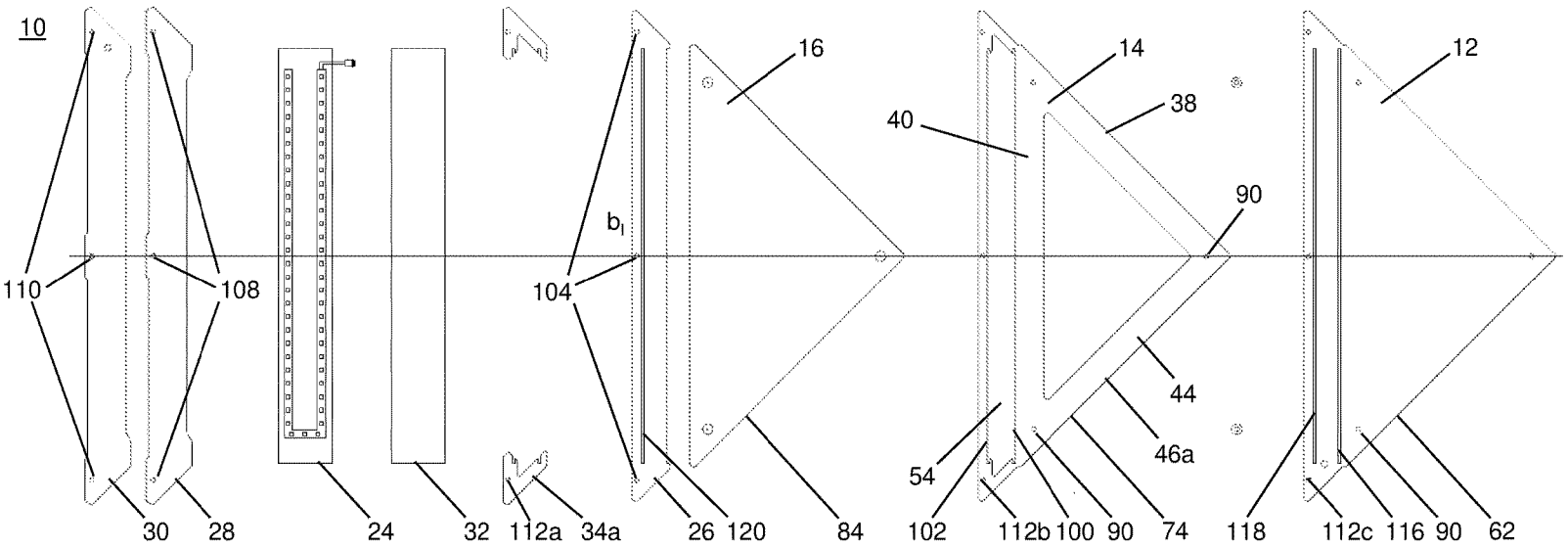
FIGS. 3A and 3B respectively show a plan view and an isometric view of the parts in the first embodiment.
Figure 3B:
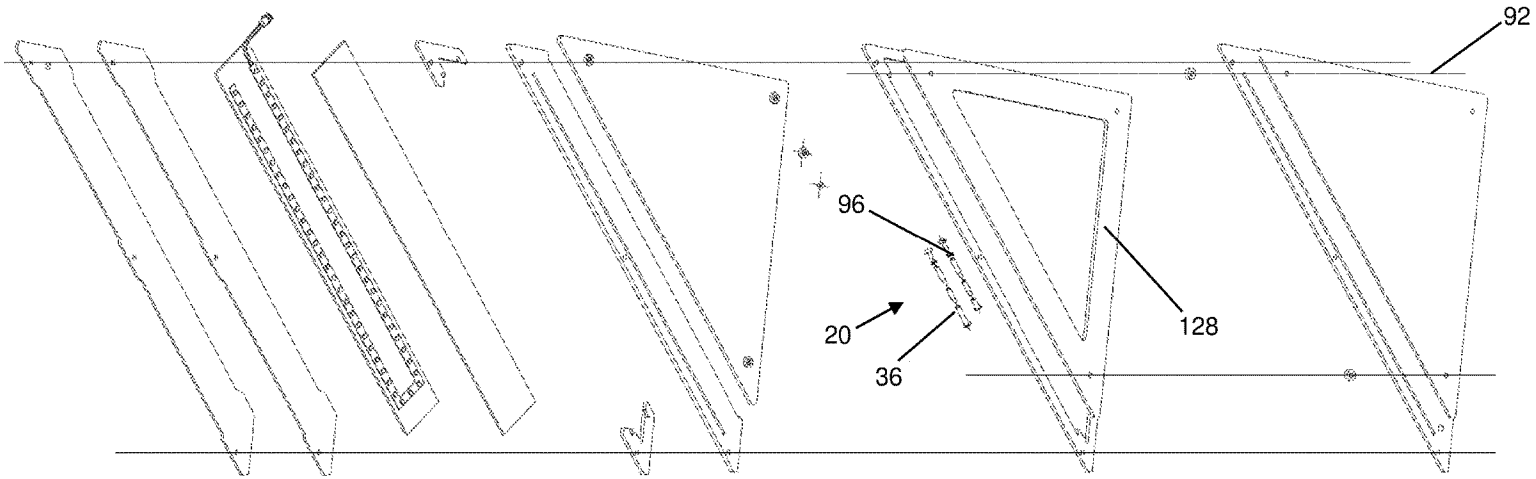

As shown in FIGS. 2I, 2J, and 3B, the mechanical fasteners 20 preferably have screw extension posts that extend through the apertures in the rear panels, the inner panels, and the spacers. The posts have threaded ends on which screw heads 96 are mounted, with one head 96*a* engaging the rear face of the rear panel and the other head 96*b* engaging the forward face of the front most inner panel. Preferably, one end of the screw extension post is externally threaded and the other end is internally threaded. Multiple screw extension posts can be screwed together to accommodate additional inner panels that increase the width of the display cases. Lock washers may also be used with the mechanical fasteners, such as between the head of a screw and the rear face of the rear panel. The screw head engaging the front face of the front most inner panel is a terminal end of the fastener that is preferably formed from a magnetically attractive material. Countersunk ring magnets are preferably attached to the rearward facing inner surface of the front panel at the corners opposite from the magnetically attractive screw heads at the front face of the inner panel. The ring magnets engage with the magnetically attractive screw heads to hold the front panel to the inner panel. It will be appreciated that the other types of mechanical fasteners could be used in place of the screw fasteners, or in combination with screw fasteners, such as layers of adhesive materials, hook and loop fasteners, and friction fit dowels.

For the magnetic fasteners 88, magnets 88*a* can be fastened to either the rearward facing inner surface proximate to the front panel upper periphery or the forward face of the inner panel side sections, and magnetically attractive material segments 88*b* are fastened opposite from the plurality of magnets to the corresponding section of the inner panel side sections or the rearward facing inner surface. For display cases that have lip segments on the front base panel, it is not as important to have magnetic fasteners at the bottom side of the front panel because when the front panel's bottom side is fit into the channel formed by the lip segments, it will not slide off of the front base panel. Accordingly, magnetic fasteners or some other type of releasable fastener are more important for the top side of the front panel.

The base chamber cover 26 has a plurality of apertures 104 spaced along its length ($b_l$), and the base chamber cover is positioned adjacent to the base chamber. The front base panel 28 is positioned adjacent to the base chamber cover and has a plurality of apertures 108 aligned with the apertures in the base chamber cover. The rear base panel 30 is positioned adjacent to the rear face of the rear panel proximate to the base chamber and has a plurality of apertures 110 aligned with the apertures in the base chamber cover. Additional spacers 34 preferably fit between adjacent pairs of inner panels 14 at their base portion 40 and the rear panel 12, and each respectively has apertures 112*a*, 112*b*, 112*c* aligned with the apertures in the base chamber cover. Mechanical fasteners 36 extend through the apertures and connect the rear base panel, the base portions of the rear panel and the inner panels, the base chamber cover, and the front base panel.

Figure 6C:
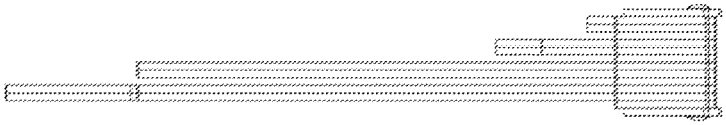
FIGS. 6A-6F show a fourth embodiment of the modular display case according to the present invention.
Figure 6B:
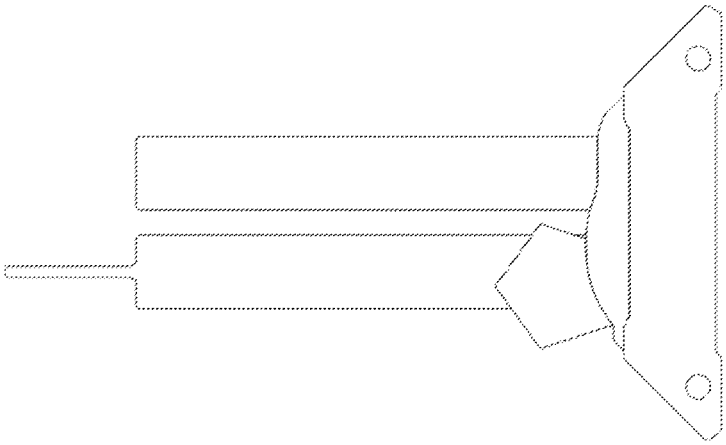
Figure 6D:
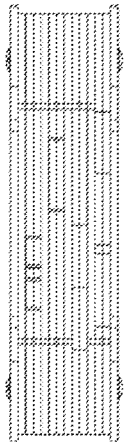
Figure 6A:
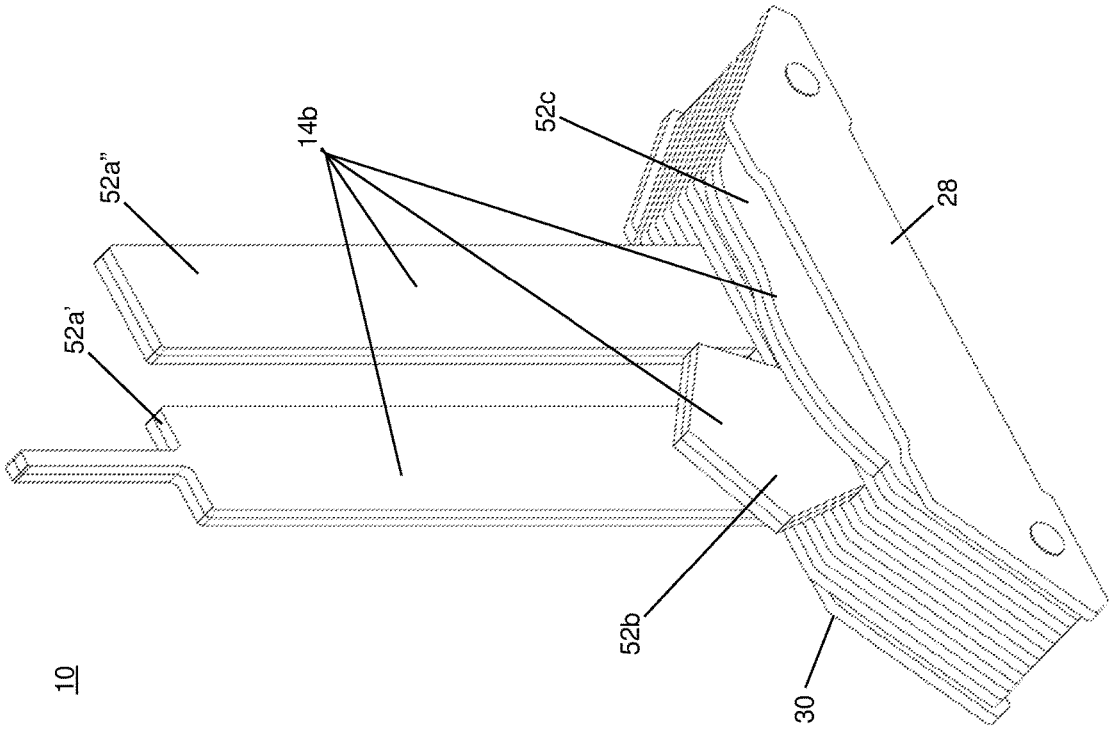
Figure 6F:
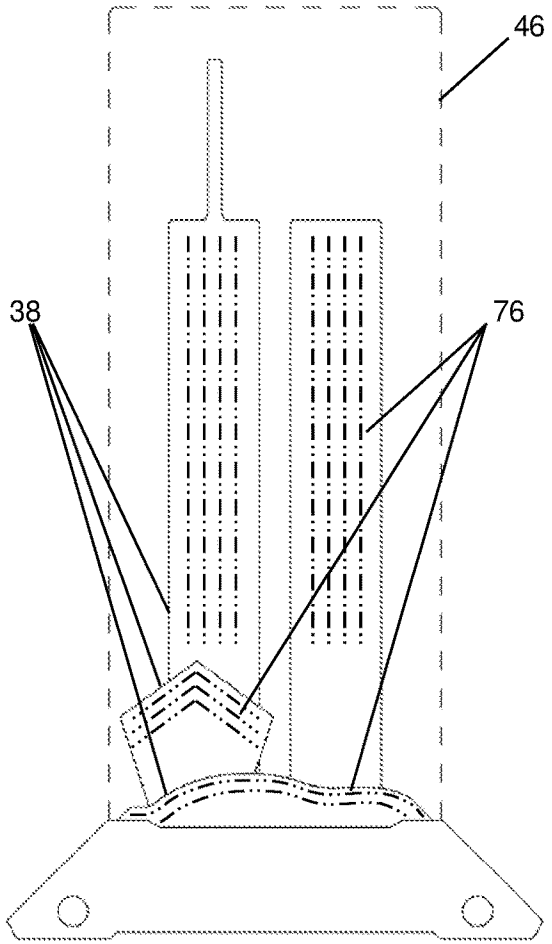
Figure 6E:
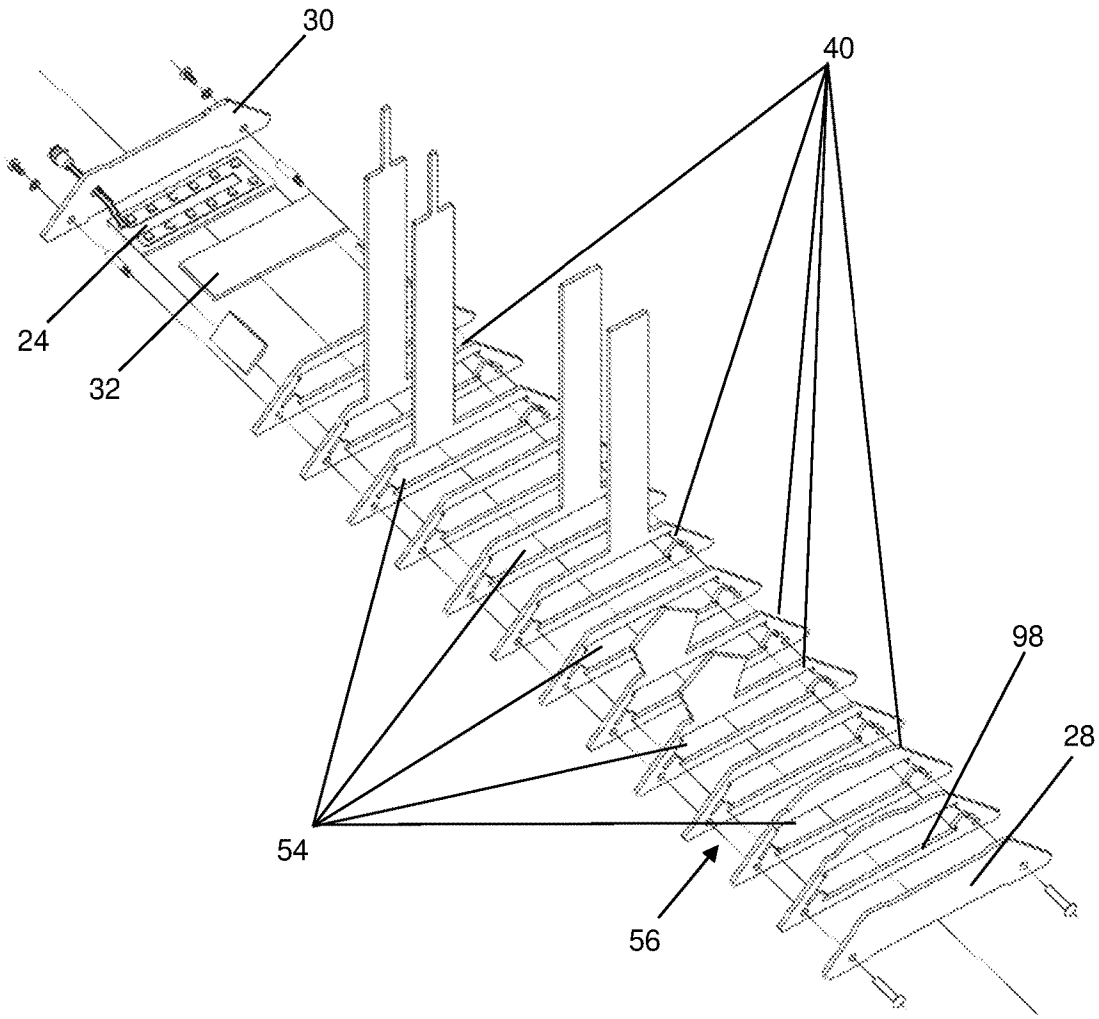
Figure 8B:
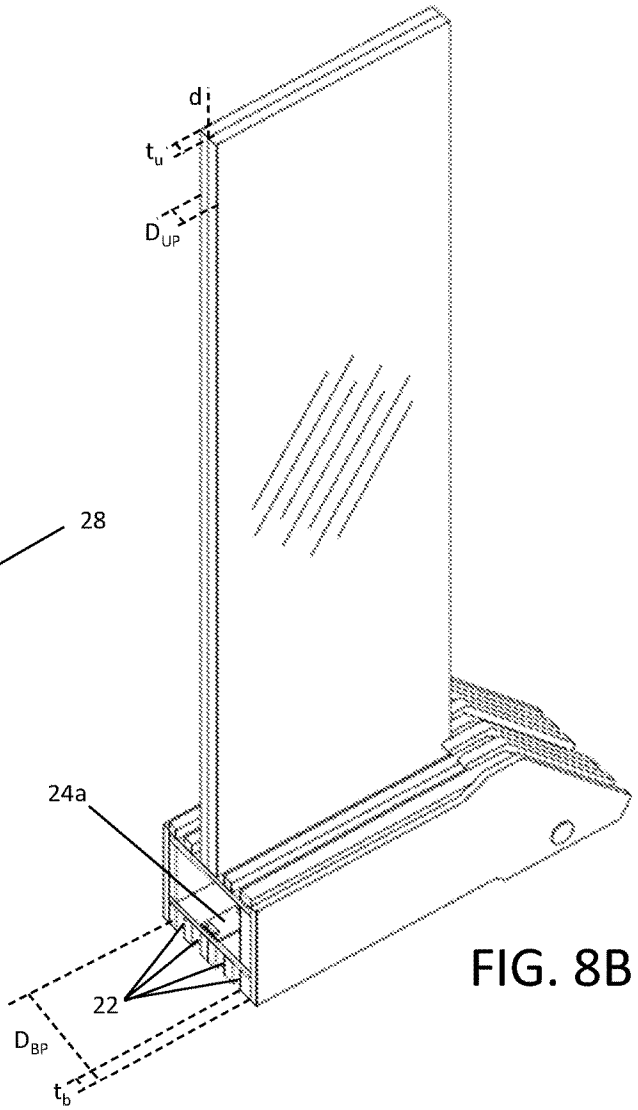
FIGS. 8A-8G show a fifth alternative embodiment of the modular display case according to the present invention.
Figure 8A:
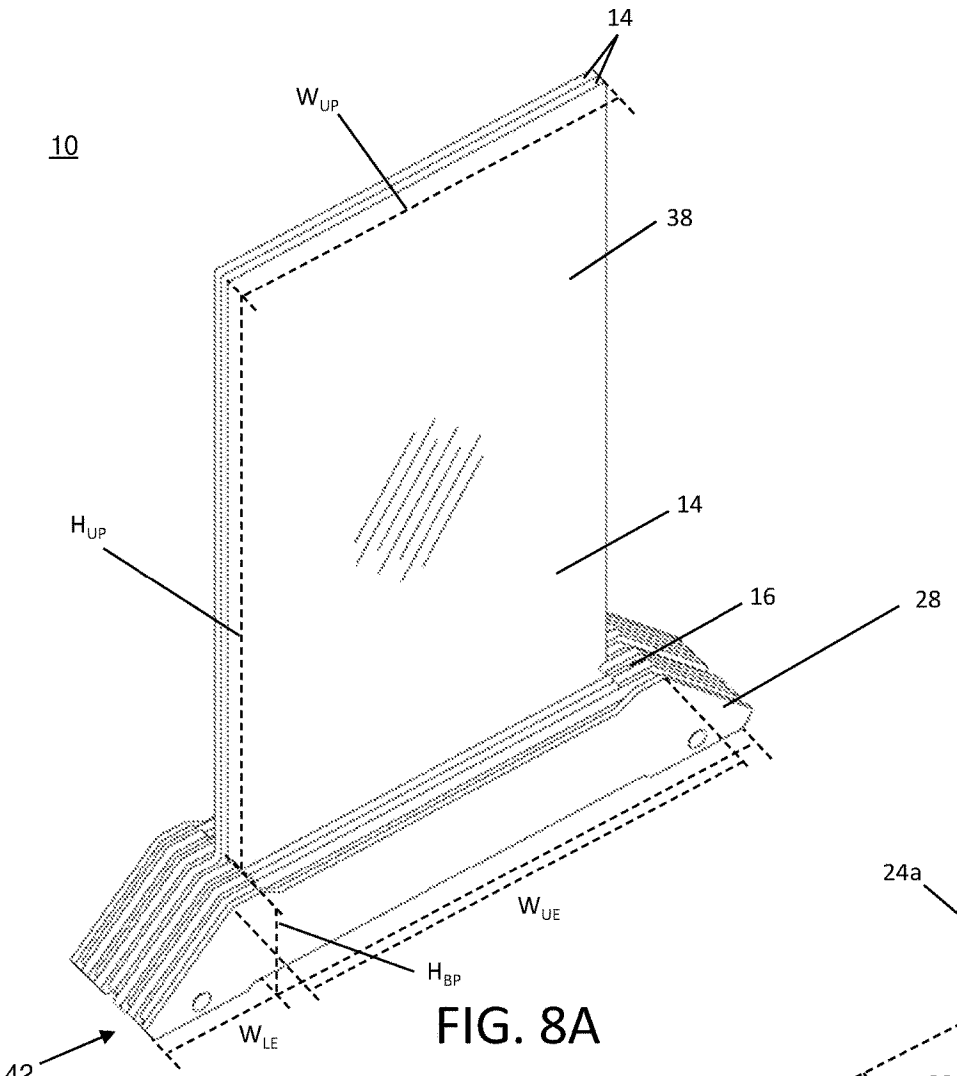
Figure 8C:
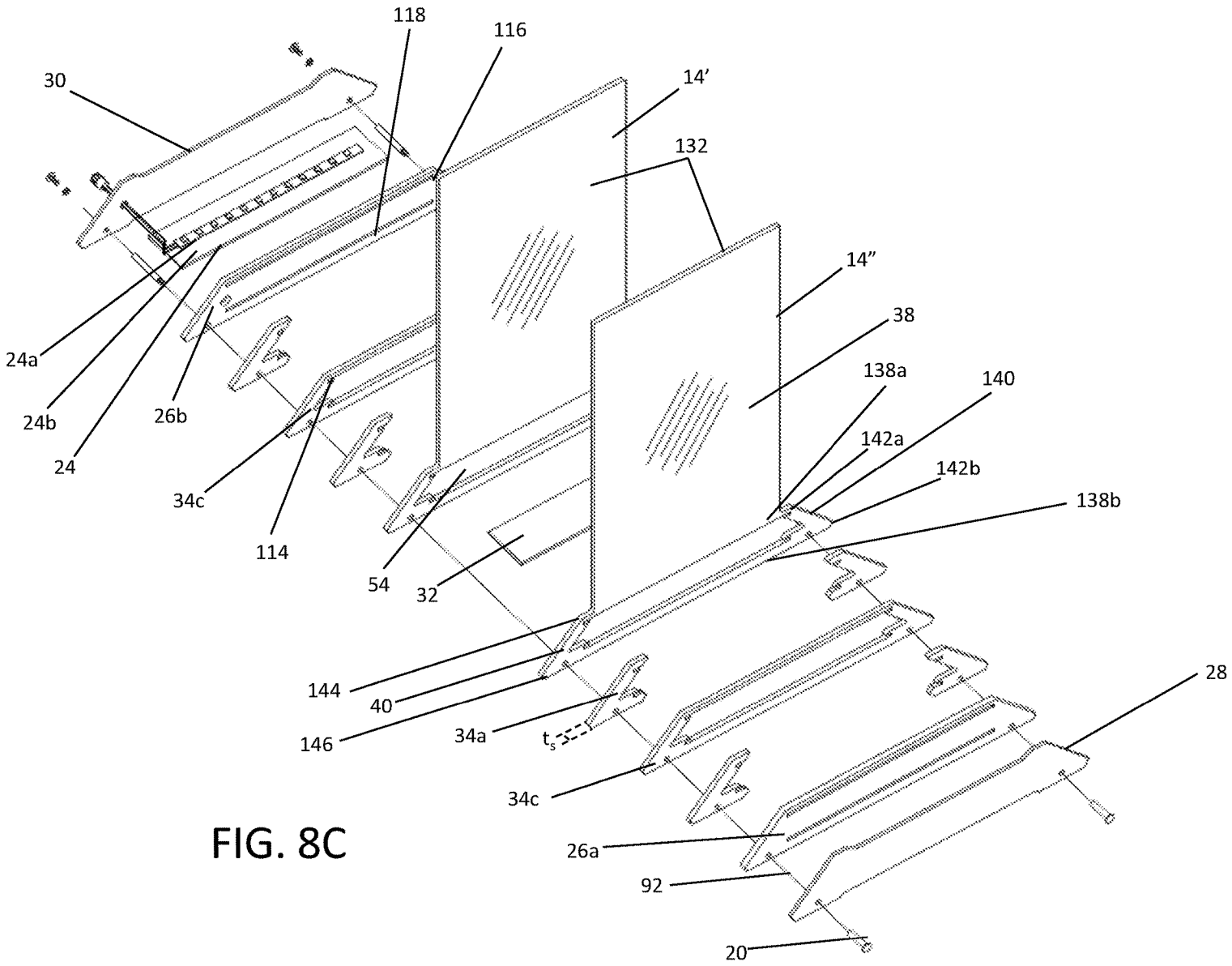
Figure 8F:
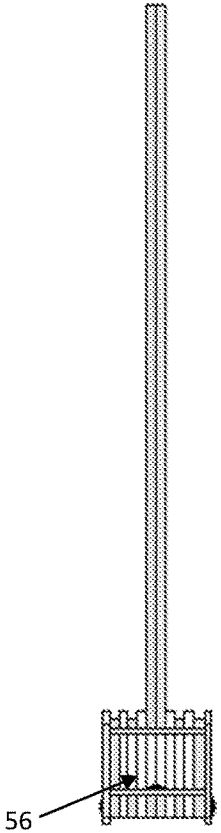
Figure 8E:
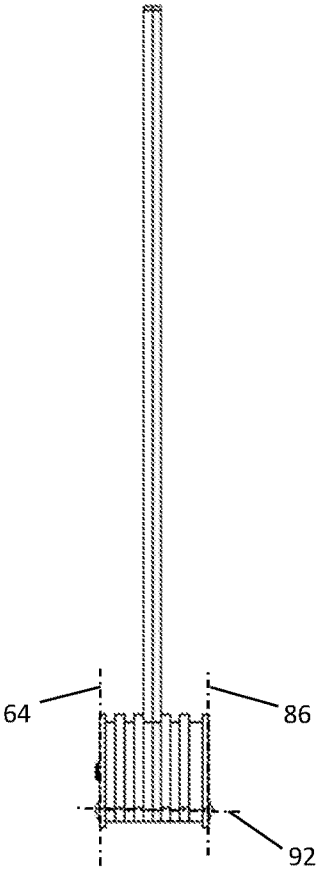
Figure 8G:
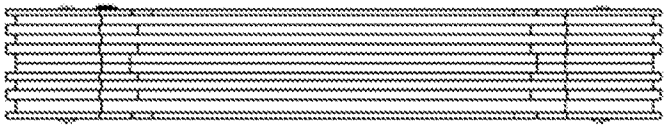
Figure 8D:
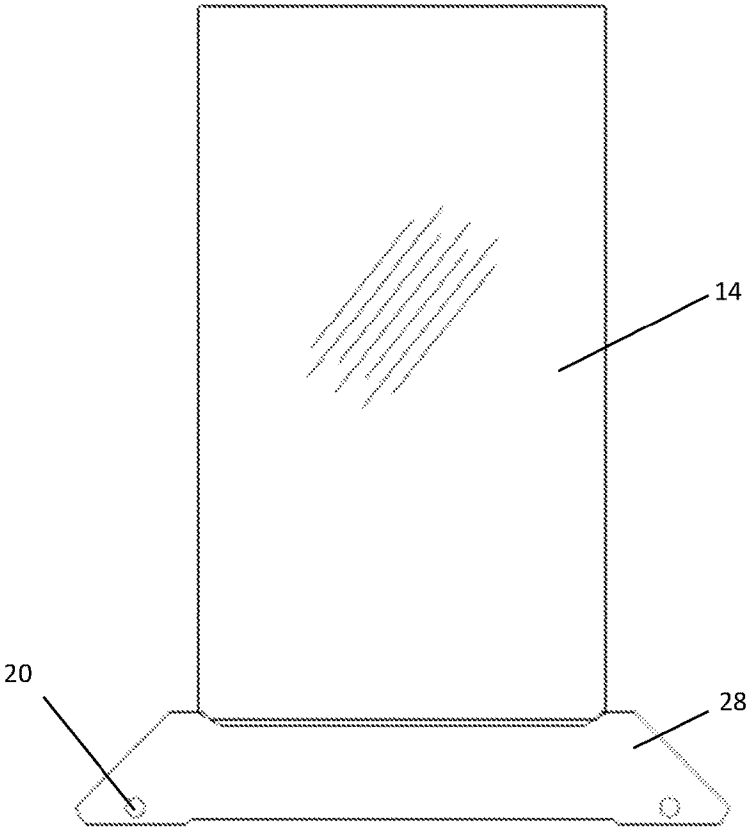
Figure 9A:
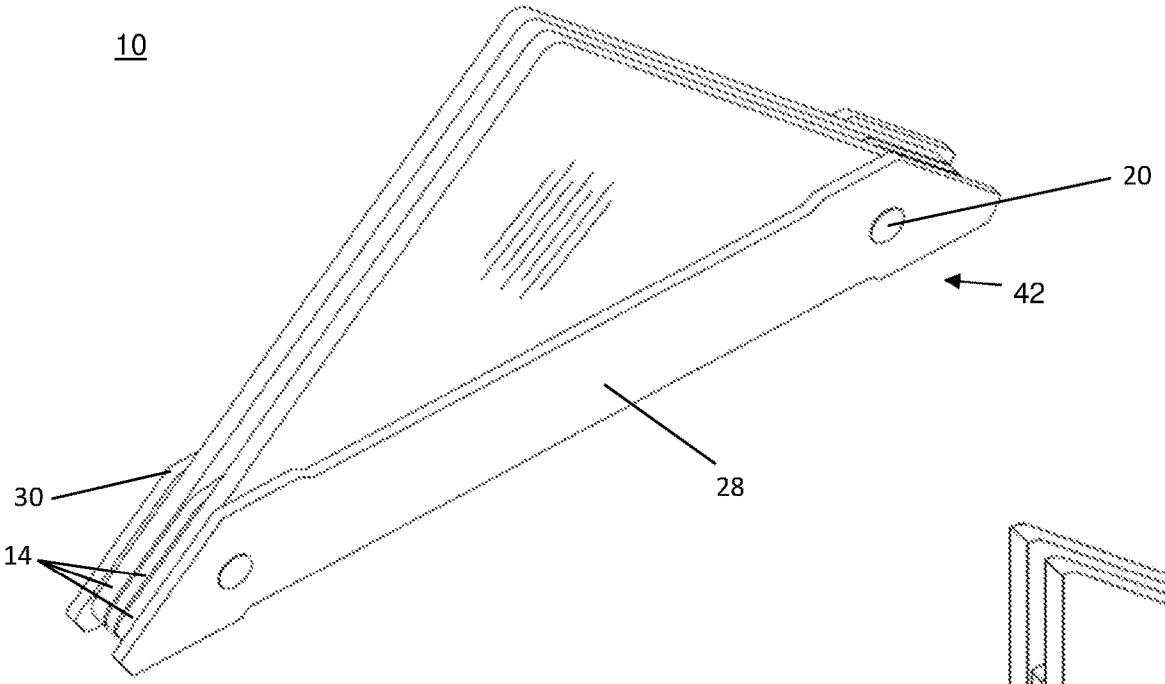
FIGS. 9A-9F show a sixth alternative embodiment of the modular display case according to the present invention.
Figure 9B:
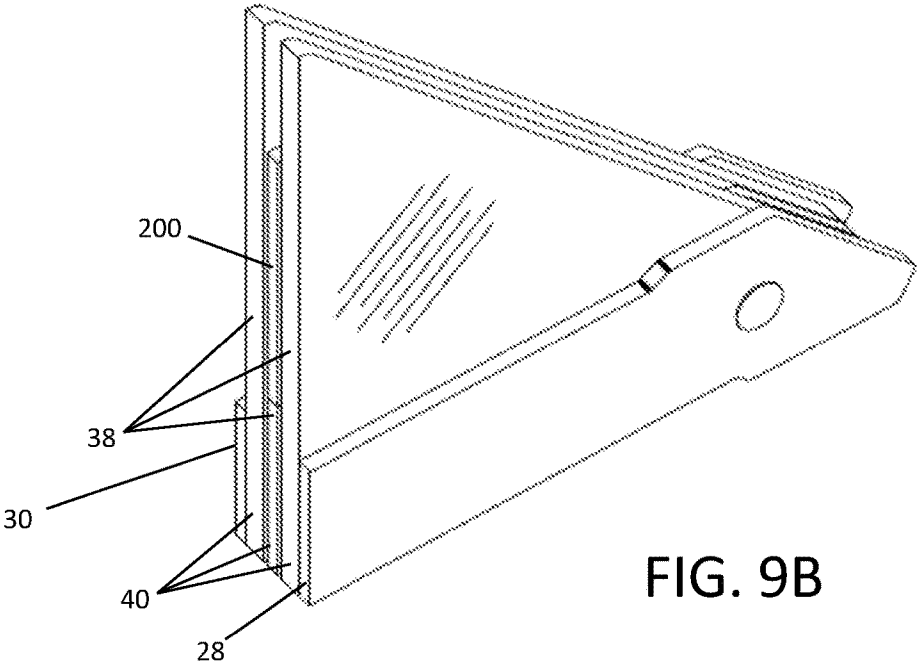
Figure 9D:
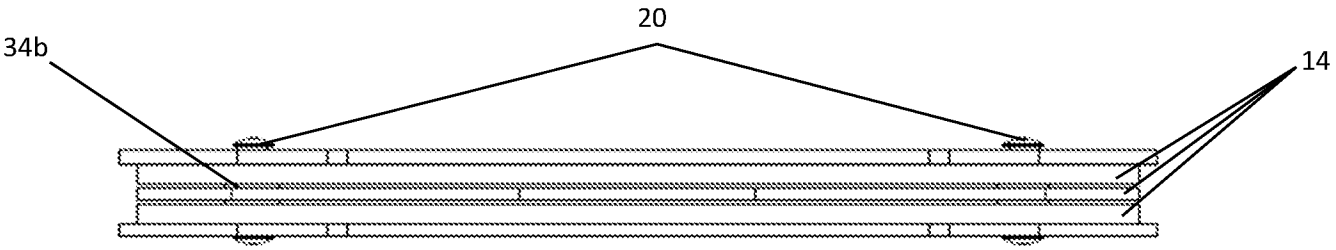
Figure 9E:
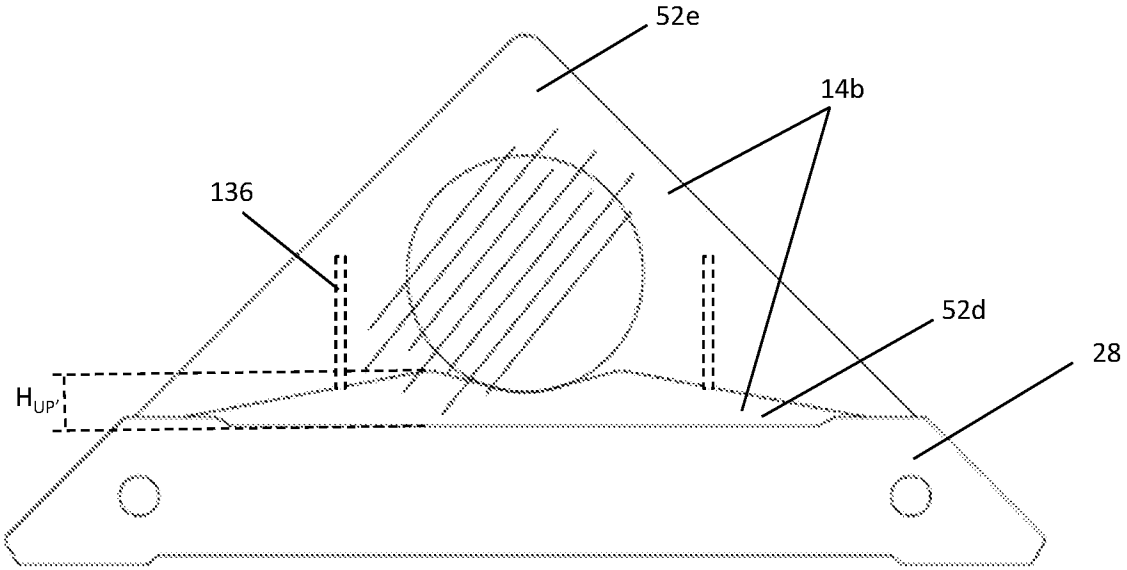
Figure 9C:
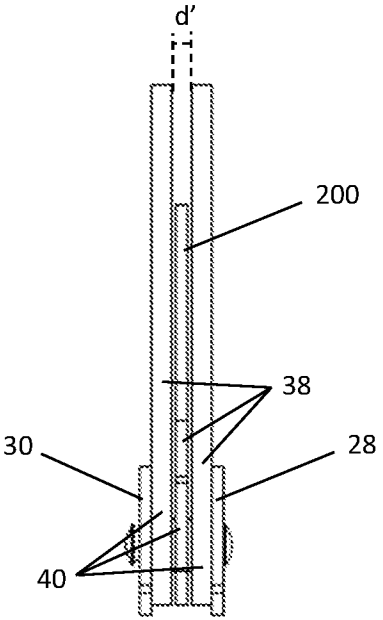
Figure 9F:
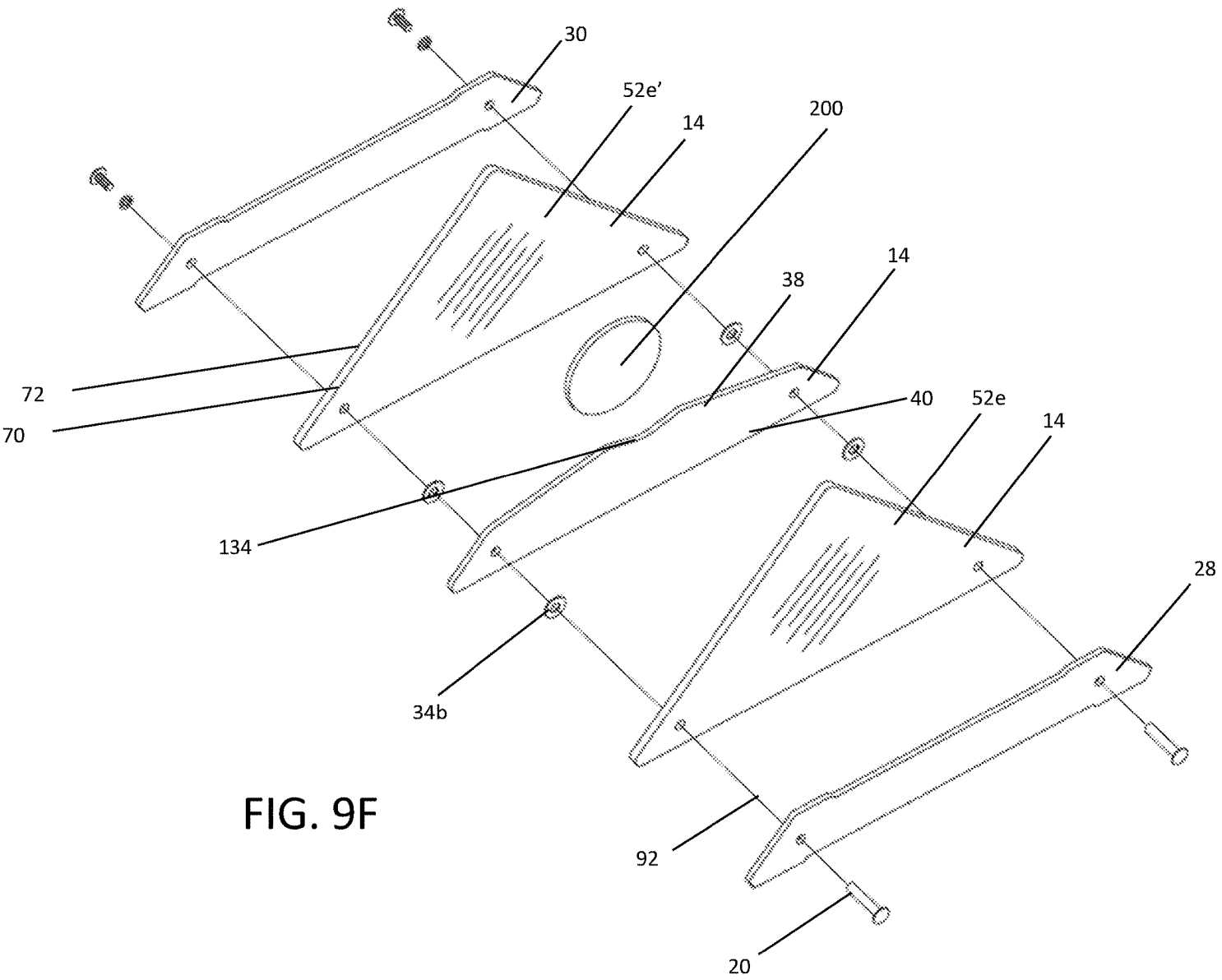

The spacers 34*a* proximate to the lateral sides of the inner panels preferably have a pair of adjacent sides 126 with a shape that matches the periphery shape of the inner panels at the side sections proximate to the base portion. Depending on the size of the display case, additional circular spacers 34*b* may be secured with fasteners between the inner panels in the bottom center section of the base portion. The spacers 34*c* could also match the entirety of the base portions of the inner panels, such as shown in FIGS. 6E and 8C. It will be appreciated that the spacers between the inner panels are not necessary, and the inner panels can be positioned against each other and against the rear and front panels. When used, the spacers create open spaces within sidewalls of the display which allows air to ventilate the display chamber and the item being displayed as well as providing a side view of the item.

Figure 4A:
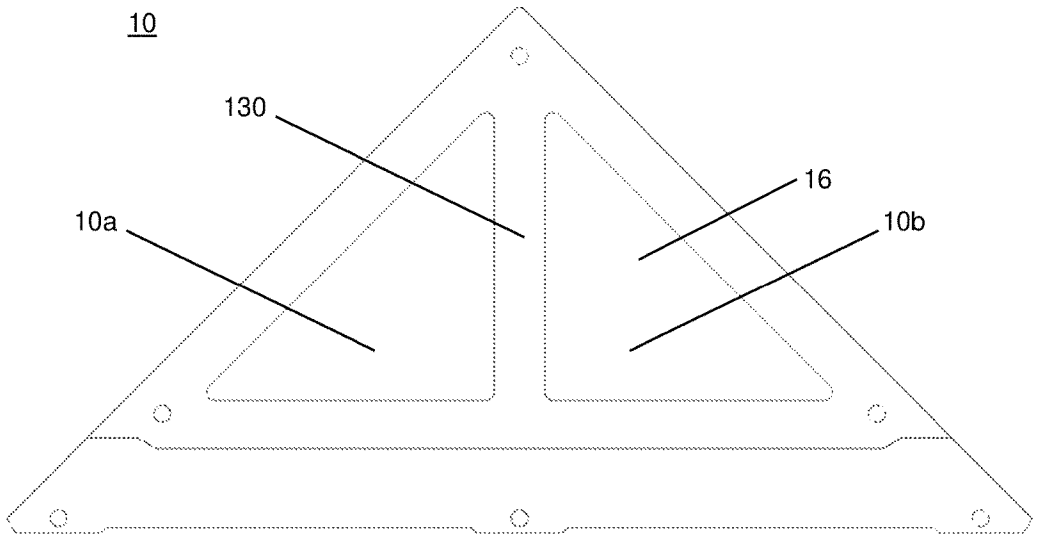
FIG. 4A shows a front view of a second embodiment of the modular display case according to the present invention.
Figure 4B:
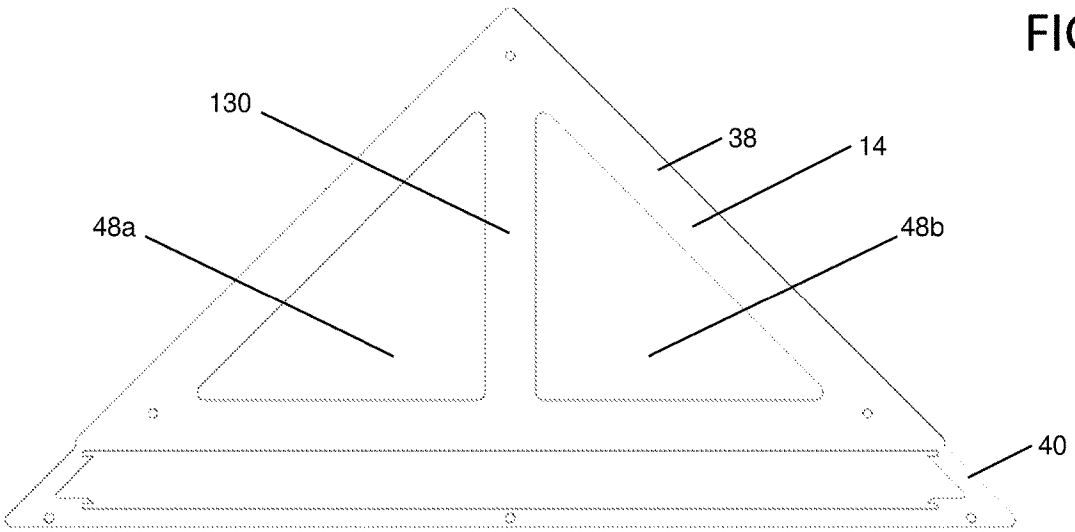
FIG. 4B shows a front view of an inner panel for the second embodiment.
Figure 5A:
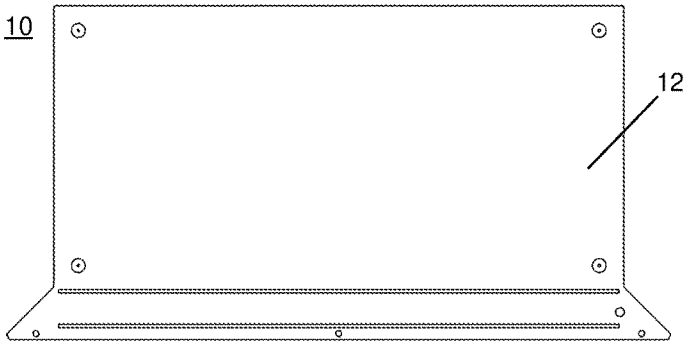
FIGS. 5A-5C show a rear panel, an inner panel, and a front panel, respectively, for a third embodiment of the modular display case according to the present invention.
Figure 5B:
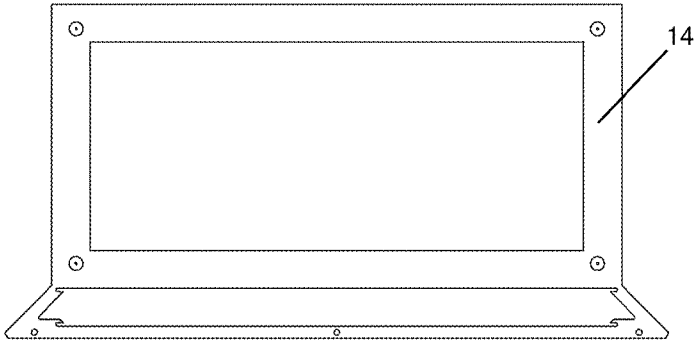
Figure 5C:
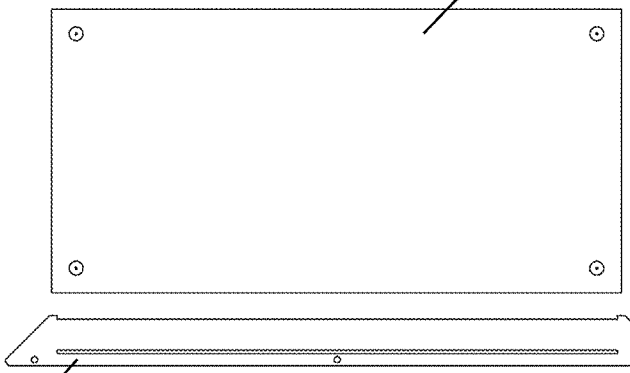

The shape of the display case can vary. For example, the embodiments shown in FIGS. 2-4 are triangular, and the embodiment shown in FIG. 5 is rectangular. The embodiment shown in FIGS. 6A-6F has an irregular shape according to the different shapes of the inner panels' upper portions, although this embodiment could have an outer periphery shape with a frame of inner panels as particularly shown in FIG. 6F and may also have a front panel and rear panel with a matching shape. As shown in FIGS. 4A and 4B, the display chamber 10 can have multiple display chamber sections 10*a*, 10*b* in the upper portion. To create multiple chamber sections, one or more internal segments 130 extend between the side sections and/or from the side sections to the base portion. In the particular embodiment shown in FIG. 4B, a central vertical internal segment divides the inner panels 14 into interior space sections 48*a*, 48*b* that form the display chamber sections.

The inner panels, the front panel, and the back panel are preferably made from transparent acrylate polymers or other transparent plastic materials, but the panels can be made from any number of materials that may be transparent, translucent, or opaque, including without limitation metal, wood, composites, china, ceramics, and glass. Since the display case according to the present invention is modular, panels made from different materials and/or different colors can be used together. For example, a display case for a "Thin Blue Line" American flag representing law enforcement may include one or more blue panels. Similarly, a display case for a "Thin Red Line" American flag representing firefighters may include one or more red panels. Other colors, designs and materials may be used or combined to create custom display cases using the modular panels according to the present invention.

Preferably, the side sections and base portion of the inner panels are formed from a single piece of transparent plastic material 128 whereas the front base panel, the rear base panel, and the lateral side spacers are preferably opaque. The opaque front and rear base panels conceal the light in the base chamber beneath the diffuser panel and also conceal the slits in the rear panel and the base chamber cover. The panels that form the display case can include various designs, graphics, messages, or other indicia that may particularly relate to the item to be displayed. The panel indicia can be produced by any means that is presently known or may be developed in the future for various types of materials, such as laser engraving, laser marking, silk screen printing, or applied vinyl cut graphics. For example, one of the front or rear panels may include a congratulatory message for a retiring officer who is gifted a display case holding a flag. Similarly, a name and date with other information or message can be included on the front or rear panel should a display case be used to display the memorial flag of a US armed forces veteran.

The removable front panel allows for different front panels with different indicia to be produced separate from the other panels that form the display case which makes customization of the display case much easier than cases in which the front panel is mechanically attached to one or more of the sides of the display case. For example, the releasable front panel also allows a person to buy the display chamber without a front panel or with a generic front panel, and without having to transport the entire display panel, the owner can then have the generic front panel modified with customized indicia or the owner can swap out the generic front panel with a customized front panel. The display chamber can hold any type of memorabilia or item that a person may want to display, such as coins, medals, ribbons, awards, souvenirs, and letters or other documents, and the interior shape of one or more of the inner panels can be formed as a stand or other support on which the item can be placed within the display chamber.

It will be appreciated that some display cases may not have a base chamber or a light below the display chamber. Additionally, for some display cases, the front and rear base panels would not be necessary even though there is a light in the base chamber. For example, it is possible for an opaque film to be placed over the bottom side of the rear panel and the base chamber cover to conceal the light panel in the base chamber beneath the diffuser panel. It is also possible for the front panel to extend all the way down to the bottom of the display case like the rear panel and still be connected to the front most inner panel with a releasable fastener. Such a front panel could also have an opaque film adhered to its bottom side to conceal the light panel in the base chamber so that the base chamber cover is not needed.

For the embodiment shown in FIGS. 6A-6F, the base portion 40 of the inner panels 14 have a cutout section 54 and a bottom edge 98 as in the other embodiments described above, but the upper portions 38 of the inner panels have different shapes in this embodiment as compared to inner panel with the same shape in the other embodiments. A set of flat, machine-cut shapes are stacked and fastened together using male-female screw posts to create the display with the light panel in the base chamber below the display. In the particular embodiment, the upper portions are cut in shapes that represent the places involved in the 911 terrorist attacks, including the World Trade Center towers in New York, N.Y., the Pentagon in Washington, D.C., and the field in Shanksville, Pa. As a tribute to the victims of the 911 terrorist attacks, the names of the victims are preferably laser engraved into the upper portions corresponding with the places where they perished. It will be appreciated that other shapes could be formed in the inner panels for any type of tribute, memorial, or other commemorative display. The front panel, back panel, and inner panels can include an outer periphery shape that provides a frame for the upper portion shapes in the inner panels, such as the rectangular frame 46 shown in FIG. 6F.

Within the base chamber, the translucent layers of acrylic receive the light from the LED light strips on the light panel and direct the light into the upper portions of the inner panels to the edges of the panel which are illuminated by the light. This edge lighting of the upper portions results in a glowing appearance to the shapes. Additionally, text, graphics, and any other indicia can be laser engraved or otherwise etched into the surface of the upper portions; the etched indicia 76 also catch the light and are illuminated with a glowing appearance. The front and back panels preferably include a center section in which the bottom edge is slightly raised off of the surface on which the display case is seated which provides a space underneath the display case that allows the light to shine out onto surface.

Figure 7:
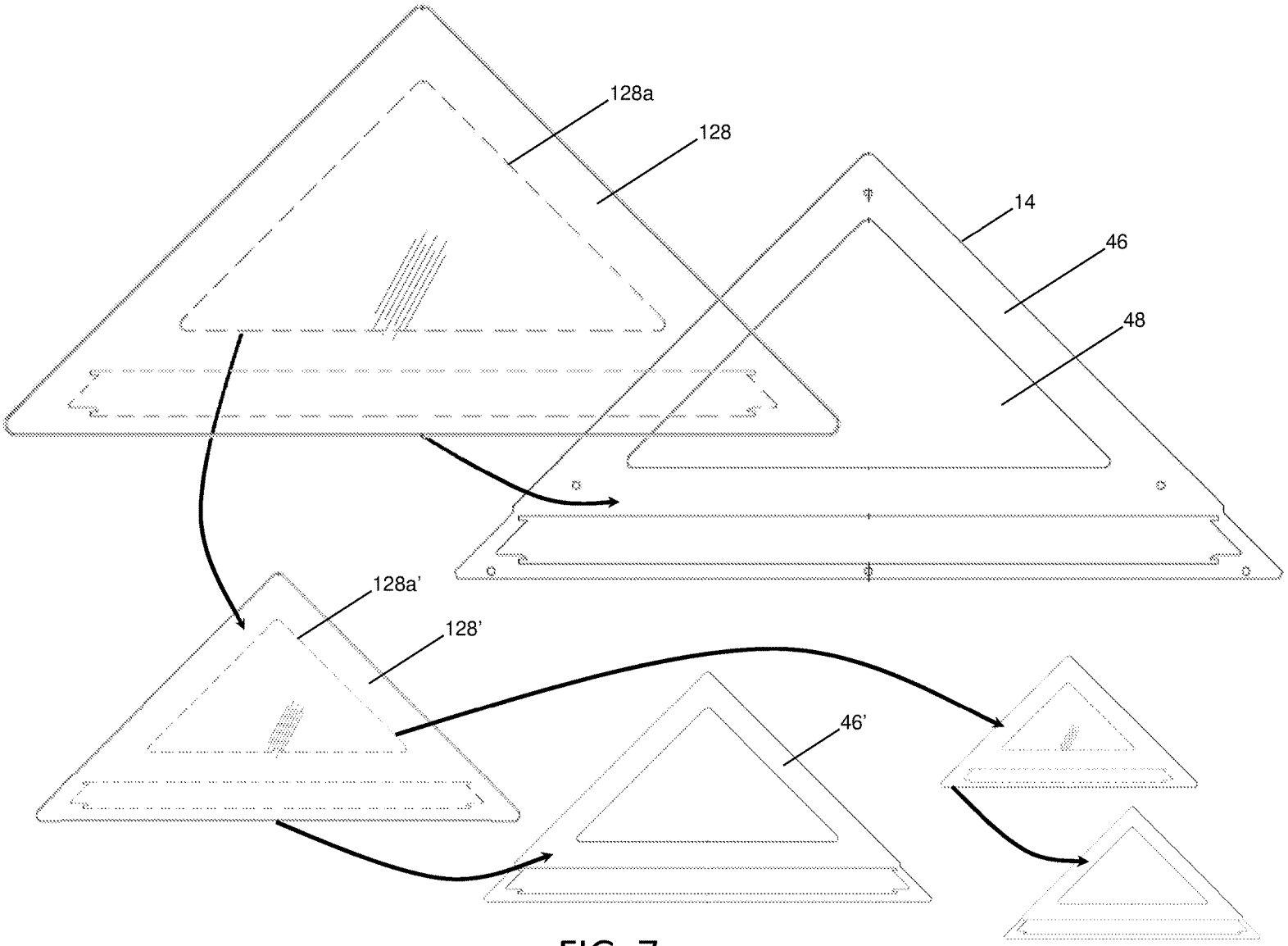
FIG. 7 is a schematic representation of the manufacturing process in which cutout sections from a larger case are used as the sheets of material for smaller cases.

In manufacturing the display case, it is an aspect of the invention to create the separate planar sheets which are modularly assembled into the three-dimensional display case as described above. It is also an aspect of the manufacturing method in making the display case described herein to use most of the materials in a single sheet of material from which the multiple panels described herein are cut. For example, as shown in FIG. 7, the section of the sheet that is cut from each inner panel to form the space in the inner panel has the same general shape as the case. Generally, the frame 46 of the inner panels is formed from a solid panel 128 with an internal region 128*a* removed to produce the interior space 48 within the frame. The internal region has a second shape that is a scaled-down copy 128' of the first shape, and a scaled-down internal region 128*a*' is removed from the internal region to form a scaled-down frame 46'. The scaled-down frame forms scaled-down inner panels for a scaled-down version of the display case. Accordingly, these cutout sheet sections that are removed from the inner panels to form the space are preferably used as the sheets of material for a smaller display case. Naturally, the outer periphery of the smaller case is slightly smaller than the dimensions of the space in the inner panel from which the cutout sections have been taken. It will also be appreciated that the cutout sections from the smaller case could similarly be used as the sheets for making an even smaller display case. Accordingly, by producing multiple display cases of different sizes from a single sheet of material, the present invention maximizes the material that can be used in the sheets and minimizes the amount of scrap material that remains from the manufacturing process.

In other alternative embodiments shown in FIGS. 8 and 9, items may be displayed between upper portions of inner panels rather than within a display chamber as described above. In the alternative embodiment shown in FIGS. 8A-8G, the display case includes inner panels 14 having a base portion 40 which may include aligned cutout sections 54 that collectively form a base chamber 56 as with the other embodiments particularly shown in FIGS. 1-3 and which are described above. Further, at least two inner panels include upper portions 38 situated above the base portion such that the item being displayed, such as a banner or certificate, is wedged between the adjacent upper sections that have opposing interior faces 132 that are spaced a distance (d) but proximal to one another in the preferred embodiment and which may substantially abut one another in another embodiment without any distance therebetween. Although this embodiment is preferably used to display items that are substantially planar in shape, it will be appreciated that distance of the space between the upper portions could vary and the display could be used for items with more irregular shapes and thicknesses, such as flags and coins as shown in FIG. 9.

As with the other embodiments described herein, the inner panels are preferably made from a clear acrylic or similar transparent material, and opaque front and rear base panels 28, 30 are therefore provided for a more aesthetically pleasing look. In displays with a base chamber that hold LEDs for illuminating the display, chamber covers 26*a*, 26*b* may also be provided between the base portions of the front most and rearmost inner panels and the respective front and rear panels, as shown in FIG. 8C. Alternatively, other embodiments may not include base covers at all and instead attach the front and rear base panels directly to the respective inner panels.

Although the simplest design may only include two inner panels with a front and rear base panel connected forward and rearward of the respective inner panels, the preferred design includes an additional front panel 16 and rear panel 12 on opposite sides of the pair of inner panels that receive the item being displayed with the front panel being releasable as described above or fixed in an alternative design. Furthermore, the additional sets of inner panels may also be provided on opposite sides of the pair of inner panels without having an upper portion such that the base of the display is substantially wider than the upper portion even if no spacers are provided.

Similar to the other embodiments described above, the panels may be spaced apart by spacers or may be arranged immediately next to one another. However, it is preferred that no spacer is provided between the inner panels having upper sections for displaying the item, such as particularly shown in FIGS. 8A and 8C, so that the opposing interior faces of the upper portions wedge the item between the panels as described above. Furthermore, the upper sections of the panels in the embodiments shown in FIGS. 8 and 9 are preferably devoid of any fasteners so that they may slightly bend and flex away from one another to receive items that are being displayed which may have a thickness that is greater than the provided space between the opposing upper portions. Accordingly, the upper portions allow for storage of various items which may have uneven surfaces such as raised seals, or thicker materials such as felt, fleece or burlap without damage to the item of significance such as splaying or pilling of the fibers.

Items can also be situated in the display embodiments shown in FIGS. 8 and 9 by undoing the mechanical fasteners to partially disassembly the display for insertion of the display item between the upper portions of the panels. Furthermore, a releasable front panel may also be included in these alternative embodiments to more quickly display an item. As with the other embodiments described herein, the preferred mechanical fasteners extend along lateral axes 92 that are perpendicular to the longitudinal planes of the panels 86, 64 through apertures in the base portion of each panel as well as through apertures in the spacers when the spacers are provided. However, it will be appreciated that alternative fasteners or sealing mechanisms could also be used to connect the panels to one another without departing from the invention described herein, such as adhesives or hook and loop fasteners that do not necessarily include a post extending through apertures in the base portions but which instead are situated between each panel.

In another aspect of the display described herein and with particular regard to the embodiments shown in FIGS. 8 and 9, the base portions preferably form a trapezoidal prism that acts as a base for the upper portions and item being displayed as described herein. Although the base portions may also form alternative shapes, such as a square or rectangle, each of the preferred base portions include an upper edge 138*a*, a lower edge 138*b* and a pair of angled side edges 140 having a top 142*a* and bottom end 142*b* respectively connected between opposing ends of the upper edge 144 and lower edges 146. Thus, the trapezoidal shape is created because the width of upper edge of the base portion ($W_{UE}$) is less than the width of the lower edge ($W_{LE}$) and the side edges are angled from the lower edge to the upper edge ($W_{UE}<W_{LE}$). It will also be appreciated that panels having upper portions also include an upper portion width ($W_{UP}$) that may be uniform as shown in rectangular upper portions depicted in FIG. 8 or irregular as shown in triangular upper portions depicted in FIG. 9. In the preferred embodiments with square or triangular upper portions, the upper portion width is no greater than the width of the upper edge of the base ($W_{UP}\leq W_{UE}$) but the height of the upper portion ($H_{UP}$) between the top and bottom edges is greater than the height of the base portion ($H_{BP}$) between the upper and lower edges ($H_{UP}>H_{BP}$). However, it will be appreciated that the width of the upper portion may be greater than the width of the base support at various locations in alternative embodiments, such as with upper portions having an oval or irregular shape (not shown). In addition, spacer 34*c* may also be incorporated into the display that match the shape of the base portions and which may also include cutout sections to expand the dimensions of the base chamber.

The display also includes a depth along the base portion ($D_{BP}$) and the upper portion ($D_{UP}$) that are respectively defined by the combined thicknesses between the faces 70, 72 of the panels along their base ($t_b$) and upper portions ($t_u$) the thickness of the spacers ($t_s$) that may be provided between the panels. In operation, the thickness of the panels having an upper portion is preferably equal between their base portion and upper portion. However, the resulting depth of the display can vary between base portion and upper portion because the front and rear base panels are aligned with the base portion, it is not required for all of the panels to include upper portions and spacers may be also provided between the base portions.

In the embodiment shown in FIG. 9, another inner panel 14 having an upper portion 38 with a holding shape 52*d* may be situated between the pair of inner panels such that the additional inner panel with the holding shape further spaces the pair of inner panels by a distance (d'). As with the embodiments discussed above and particularly shown in FIG. 6, the shape of the upper portion of the inner panel 52*d* between the pair of inner panels is different than the shape of the upper portion of the pair of inner panels 52*e*, 52*e*'. In the particular embodiment shown in FIG. 9, the holding shape of the panel 52*d* between the pair of panels provides a functional benefit wherein a depression 134 is provided in the top edge to more securely support the item being displayed. In other alternative embodiments, other holding shapes may be used for more securely holding display items, such as posts 136 for suspending a ribbon. More particularly, the upper portion of the panel having the holding shape includes an upper portion height ($H_{UP'}$) between its top and bottom edge that is less than the height of the upper portions of the pair of inner panels ($H_{UP}$) on opposite sides of the other panel ($H_{UP'}<H_{UP}$). It will also be appreciated that the alternative embodiment shown in FIG. 9 could also include multiple other panels between the pair of inner panels to further space the pair of panels from each other and more readily accommodate wider items 200, such as a thick coin or similar item.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the embodiments all show multiple inner panels that are intended to display objects with a thickness greater than a single inner panel, it will be appreciated that a single inner panel could be used to hold objects that are thinner than its thickness (or its thickness with a set of spacers), such as a document, a banner, or a coin. Additionally, it will be appreciated that some display cases could lay flat on the rear face in which case the longitudinal plane of the rear panel would actually be in a lateral orientation. Thus, the breadth and scope of the present invention should not be limited by any of the above-described exemplary embodiments, but should be defined only in accordance with the following claims appended hereto and their equivalents.

What is claimed is:

1. A modular display case, comprising:

a plurality of inner panels fastened together, wherein each of the inner panels comprise a base portion, wherein at least a pair of the inner panels further comprise an upper portion extending above the respective base portions, and wherein the base portion in each one of the inner panels further comprises a cutout section between an upper side and a lower side;

a front base panel positioned forward of a front most inner panel from the plurality of inner panels, wherein the upper portion of the inner panels extend above the front base panel;

a rear base panel positioned rearward of a rearmost inner panel from the plurality of inner panels, wherein the upper portion of the inner panels extend above the rear base panel; and a plurality of fasteners respectively connecting the base portions of the inner panels to one another and to the front base panel and the rear base panel.

2. The display case of claim 1, wherein each of the inner panels, the front base panel and the rear panel are respectively situated in a plurality of adjacent longitudinal planes, wherein each of the base portions further comprise a set of apertures located proximate to an outer periphery of the respective base portions, wherein the apertures within each of the base portions align along a set of lateral axes substantially perpendicular to the adjacent longitudinal planes, wherein each of the plurality of fasteners comprises a mechanical fastener extending through each of the apertures along the lateral axes, and wherein a pair of opposing terminal ends of at least one of the mechanical fasteners respectively connect to the front base panel and the rear base panel.

3. The display case of claim 2, further comprising a plurality of spacers, wherein the spacers each have an aperture and are positioned between the inner panels, wherein the lateral axes extend through the apertures of the respective spacers, and wherein the mechanical fasteners extend along the axes through the apertures of the spacers.

4. The display case of claim 1 further comprising a front panel and a rear panel, wherein the front panel is situated between the front base panel and the front most inner panel, and wherein the rear panel is situated between the rear base panel and the rearmost inner panel.

5. The display case of claim 4, wherein the front panel is spaced from the rear panel by the inner panels and releasably secured to the front most inner panel by another fastener, wherein the front panel has a front face, a rearward facing inner surface, a bottom side, and an upper periphery, and wherein the upper periphery substantially matches and is aligned with a periphery shape of the upper portion of the inner panels.

6. The display case of claim 1, wherein the cutout sections for the inner panels align and collectively form a base chamber.

7. The display case of claim 6, further comprising a base chamber cover connected to the base portion of one of the panels from the plurality of inner panels and positioned adjacent to the base chamber between at least one of the front base panel and the rear base panel and the respective front most inner panel and rearmost inner panel.

8. The display case of claim 6, further comprising a light and a diffuser panel, wherein the light is situated in the base chamber, wherein the diffuser panel is held within the base chamber and situated between the light and the upper side of the respective cutout sections.

9. The display case of claim 1, wherein the base portion in each of the inner panels further comprise an upper edge, a lower edge and a pair of angled side edges, wherein the upper edge and the lower edge each comprise a pair of opposing ends respectively spaced by an upper width and a lower width, wherein the angled sidewalls each comprise a top end connected to the opposing ends of the upper edge and a lower end connected to the opposing ends of the lower edge, and wherein the lower width is greater than the upper width.

10. The display case of claim 1, wherein another inner panel from the plurality of inner panels is situated between the pair of inner panels, wherein the other inner panel further comprises another upper portion extending above the base portion, wherein the upper portion of the pair of inner panels has a first shape, and wherein the upper portion for the other inner panel has a second shape different from the first shape.

11. The display case of claim 1, wherein each of the inner panels, the front base panel and the rear base panel further comprise a thickness between an outer face and an inner face, wherein the respective inner faces of the pair of inner panels mirror one another, wherein the thickness of each of the base portions, the front base panel and the rear base panel collectively form a display base portion depth, wherein the thickness of each of the upper portions collectively form a display upper portion depth, and wherein the base portion depth is at least as great as the upper portion depth.

12. A modular display case comprising:

a plurality of inner panels fastened together, wherein each of the inner panels comprise a base portion, wherein at least a pair of the inner panels further comprise an upper portion extending above the respective base portions, wherein the base portion in each one of the inner panels further comprises a cutout section between an upper side and a lower side, and wherein the cutout sections for the plurality of inner panels align and collectively form a base chamber;

a front base panel positioned forward of a front most inner panel from the plurality of inner panels, wherein the upper portion of the inner panels extend above the front base panel;

a rear base panel positioned rearward of a rearmost inner panel from the plurality of inner panels, wherein the upper portion of the inner panels extend above the rear base panel;

a base chamber cover connected to the base portion of one of the panels from the plurality of inner panels and positioned adjacent to the base chamber between at least one of the front base panel and the rear base panel and the respective front most inner panel and rearmost inner panel;

a light situated in the base chamber;

a diffuser panel held within the base chamber and situated between the light and the upper side of the respective cutout sections; and a plurality of fasteners respectively connecting the base portions of the inner panels to one another and to the front base panel and the rear base panel.

13. The display case of claim 12, wherein each of the inner panels, the front base panel and the rear panel are respectively situated in a plurality of adjacent longitudinal planes, wherein each of the base portions further comprise a set of apertures located proximate to an outer periphery of the respective base portions, wherein the apertures within each of the base portions align along a set of lateral axes substantially perpendicular to the adjacent longitudinal planes, wherein each of the plurality of fasteners comprises a mechanical fastener extending through each of the apertures along the lateral axes, and wherein a pair of opposing terminal ends of at least one of the mechanical fasteners respectively connect to the front base panel and the rear base panel.

14. The display case of claim 12, wherein the base portions of each of the plurality of inner panels is further comprised of a pair of recesses on opposite sides of the cutout section proximate to the upper side, and wherein opposite lateral ends of the diffuser panel respectively extend into the pair of recesses.

15. The display case of claim 12, wherein the base portion in each of the inner panels further comprise an upper edge, a lower edge and a pair of angled side edges, wherein the upper edge and the lower edge each comprise a pair of opposing ends respectively spaced by an upper width and a lower width, wherein the angled sidewalls each comprise a top end connected to the opposing ends of the upper edge and a lower end connected to the opposing ends of the lower edge, and wherein the lower width is greater than the upper width.

16. The display case of claim 12, wherein another inner panel from the plurality of inner panels is situated between the pair of inner panels, wherein the other inner panel further comprises another upper portion extending above the base portion, wherein the upper portion of the pair of inner panels has a first shape, and wherein the upper portion for the other inner panel has a second shape different from the first shape.

17. A modular display case comprising:

a plurality of inner panels fastened together, wherein each of the inner panels comprise a base portion, wherein at least a pair of the inner panels further comprise an upper portion extending above the respective base portions, wherein the base portion in each of the panels further comprise an upper edge, a lower edge and a pair of angled side edges, wherein the upper edge and the lower edge each comprise a pair of opposing ends respectively spaced by an upper width and a lower width, wherein the angled sidewalls each comprise a top end connected to the opposing ends of the upper edge and a lower end connected to the opposing ends of the lower edge, wherein the lower width is greater than the upper width, wherein the base portion in each one of the inner panels further comprise a cutout section between an upper side and a lower side, and wherein the cutout sections for the inner panels align and collectively form a base chamber;

a front base panel positioned forward of a front most inner panel from the plurality of inner panels, wherein the upper portion of the inner panels extend above the front base panel;

a rear base panel positioned rearward of a rearmost inner panel from the plurality of inner panels, wherein the upper portion of the inner panels extend above the rear base panel; and a plurality of fasteners respectively connecting the base portions of the inner panels to one another and to the front base panel and the rear base panel.

18. The display case of claim 4, wherein the display case further comprises a light and a diffuser panel situated within the base chamber, and wherein the diffuser panel is held within the base chamber and situated between the light and the upper side of the respective cutout section of each one of the panels.

19. The display case of claim 17, wherein another inner panel from the plurality of inner panels is situated between the pair of inner panels, wherein the other inner panel further comprises another upper portion extending above the base portion, wherein the upper portion of the pair of inner panels has a first shape, and wherein the upper portion for the other inner panel has a second shape different from the first shape.

20. The display case of claim 17, wherein each of the inner panels, the front base panel and the rear panel are respectively situated in a plurality of adjacent longitudinal planes, wherein each of the base portions further comprise a set of apertures located proximate to an outer periphery of the respective base portions, wherein the apertures within each of the base portions align along a set of lateral axes substantially perpendicular to the adjacent longitudinal planes, wherein each of the plurality of fasteners comprises a mechanical fastener extending through each of the apertures along the lateral axes, and wherein a pair of opposing terminal ends of at least one of the mechanical fasteners respectively connect to the front base panel and the rear base panel.

* * * * *